US010897965B2

(12) United States Patent
Hasegawa et al.

(10) Patent No.: US 10,897,965 B2
(45) Date of Patent: Jan. 26, 2021

(54) SNAP BUTTON AND MALE BODY FORMING METHOD

(71) Applicant: YKK Corporation, Tokyo (JP)

(72) Inventors: Kenji Hasegawa, Kanagawa (JP); Makoto Oshima, Taipei (TW); Koji Fujii, Taipei (TW)

(73) Assignee: YKK Corporation

( * ) Notice: Subject to any disclaimer, the term of this patent is extended or adjusted under 35 U.S.C. 154(b) by 94 days.

(21) Appl. No.: 16/089,160

(22) PCT Filed: Mar. 30, 2016

(86) PCT No.: PCT/JP2016/060581
§ 371 (c)(1),
(2) Date: Sep. 27, 2018

(87) PCT Pub. No.: WO2017/168666
PCT Pub. Date: Oct. 5, 2017

(65) Prior Publication Data

US 2019/0116940 A1 Apr. 25, 2019

(51) Int. Cl.
*A44B 17/00* (2006.01)

(52) U.S. Cl.
CPC ..... *A44B 17/00* (2013.01)

(58) Field of Classification Search
CPC ..... A44B 17/00
See application file for complete search history.

(56) References Cited

U.S. PATENT DOCUMENTS 488,090 A * 12/1892 Rudge ..... A44B 11/266 24/625
3,925,860 A * 12/1975 Furuya ..... A44B 17/0029 24/687
4,805,272 A * 2/1989 Yamaguchi ..... A41H 37/001 24/623

(Continued)

FOREIGN PATENT DOCUMENTS

DE 2117612 10/1971
DE 9002250 5/1990

(Continued)

OTHER PUBLICATIONS

Hasegawa, Kenji; International Preliminary Report on Patentability for PCT/JP2016/060581, filed Mar. 30, 2016, dated Oct. 11, 2018, 12 pgs.

(Continued)

*Primary Examiner* — Robert Sandy
*Assistant Examiner* — David M Upchurch
(74) *Attorney, Agent, or Firm* — Taylor English Duma LLP

(57) ABSTRACT

Provided is a snap button that can increase the productivity and reduce the thickness. The snap button includes a female snap and a male snap engageable with and disengageable from the female snap. The female snap includes a female eyelet member defining an opening. The male snap includes a male eyelet member defining an opening and an engaging member fixed to the opening of the male eyelet member. The engagement member includes a connecting part connectable to and disconnectable from the opening of the female eyelet member, and a fixing part fitted into the opening of the male eyelet member.

11 Claims, 21 Drawing Sheets

(56) References Cited

U.S. PATENT DOCUMENTS

| | | | | |
|---|---|---|---|---|
| 6,260,240 | B1 | 7/2001 | Akashi et al. | |
| 6,757,942 | B2 * | 7/2004 | Matsui | A44B 17/0029 24/114.05 |
| 9,179,743 | B2 * | 11/2015 | Momose | A44B 17/0029 |
| 2012/0180266 | A1 | 7/2012 | Hasegawa et al. | |

FOREIGN PATENT DOCUMENTS

| | | |
|---|---|---|
| GB | 1319732 | 6/1973 |
| JP | 52-012332 | 4/1997 |
| JP | 2000157310 | 6/2000 |
| WO | 2011040107 | 4/2011 |

OTHER PUBLICATIONS

Hasegawa, Kenji; International Search Report and Written Opinion for PCT/JP2016/060581, filed Mar. 30, 2016, dated Jun. 14, 2016, 12 pgs.

* cited by examiner

[FIG. 1]
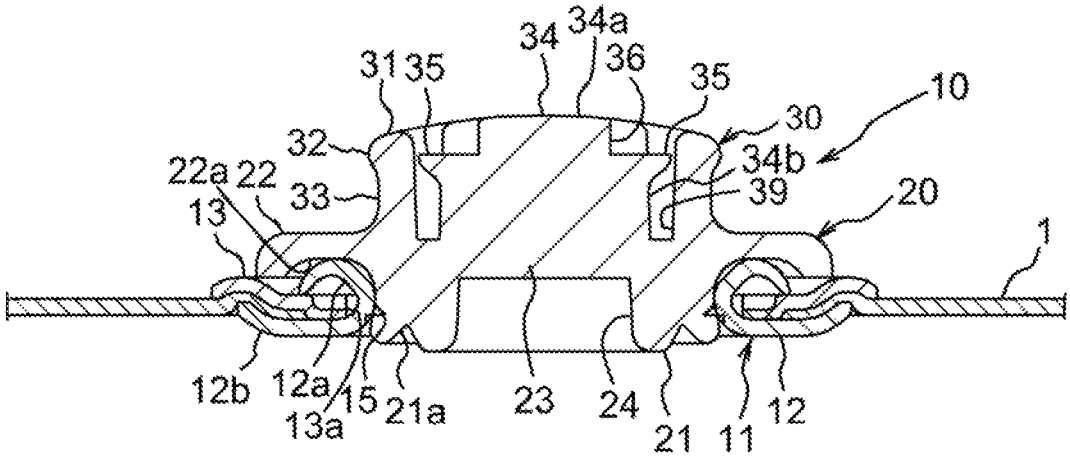

[FIG. 2]
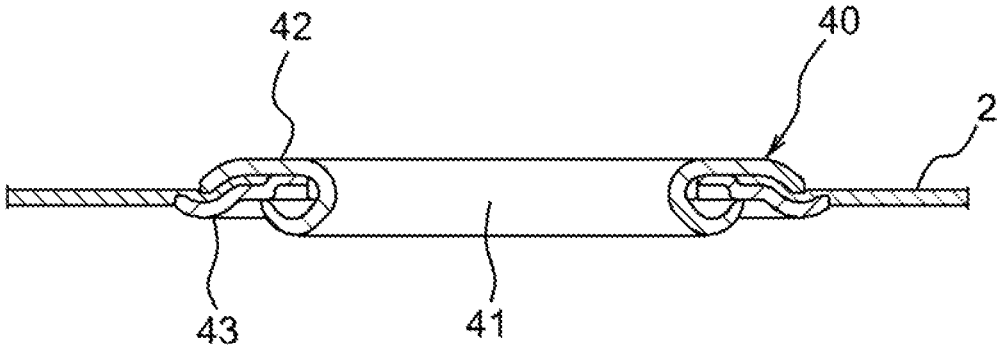

[FIG. 3]
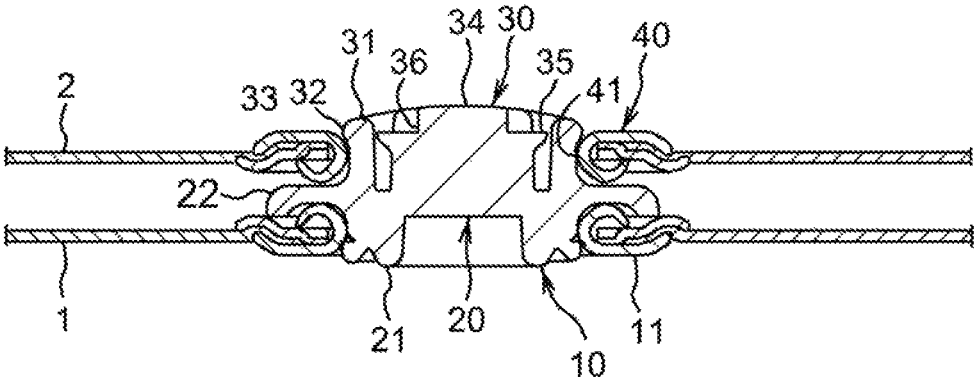

[FIG. 4]
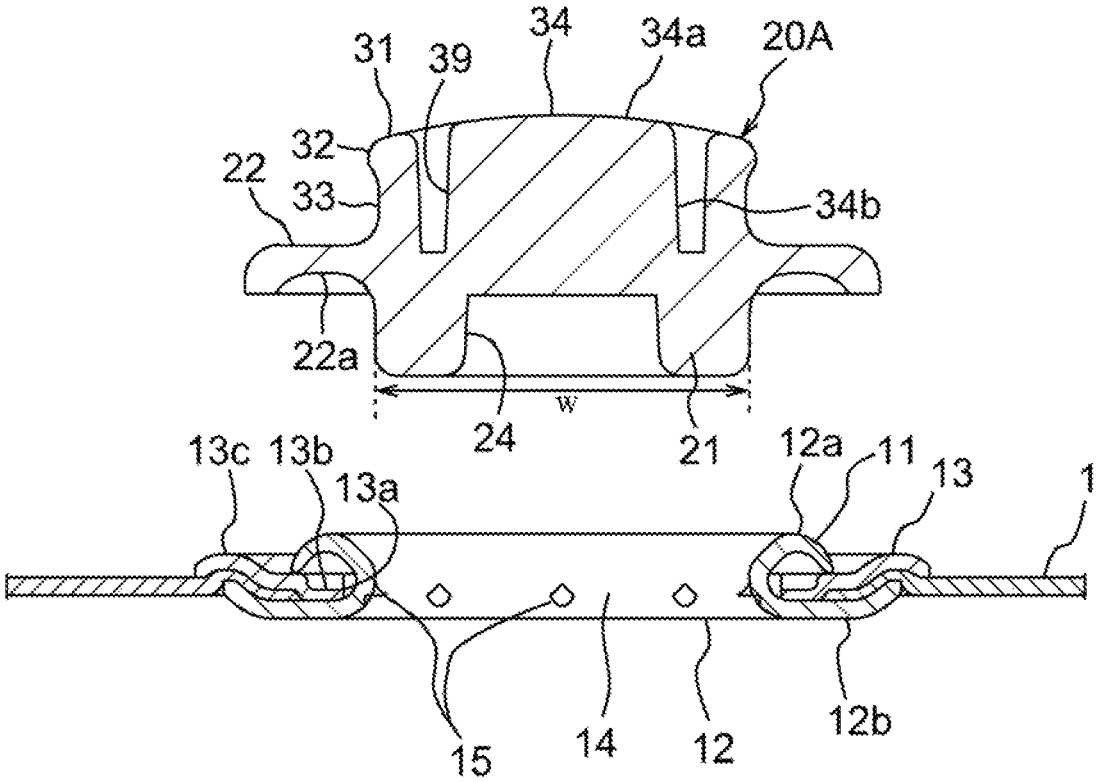

[FIG. 5]
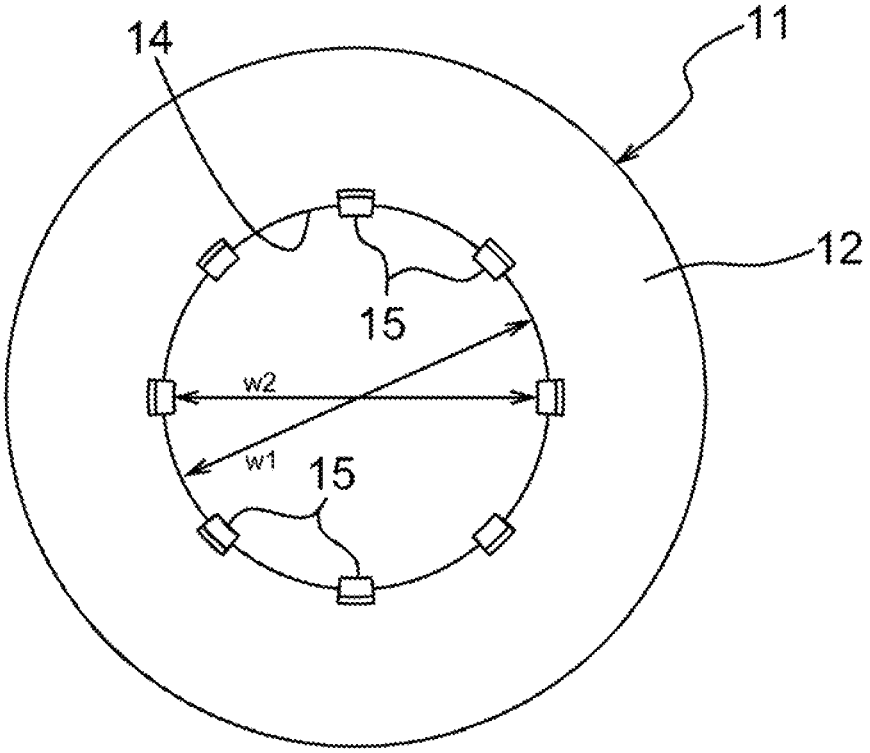

[FIG. 6]
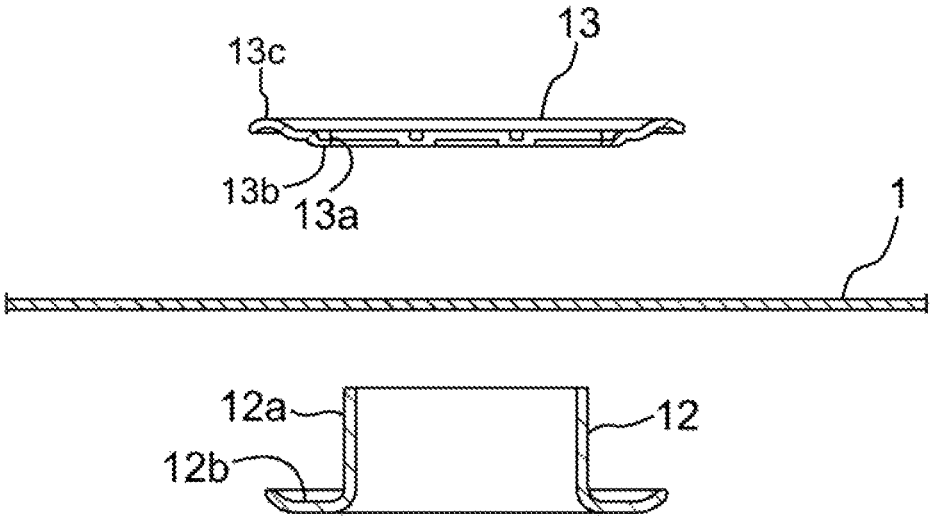

[FIG. 7]
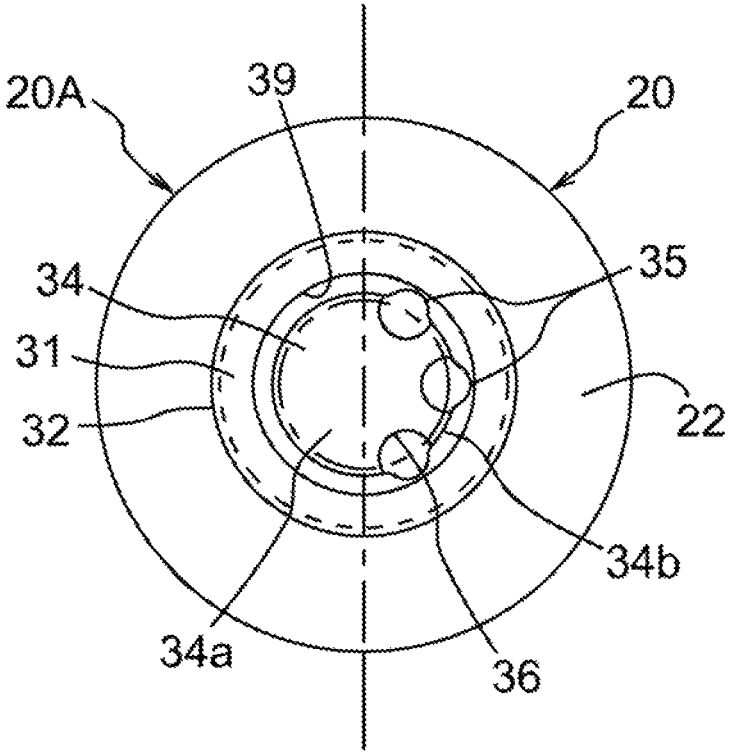

[FIG. 8]
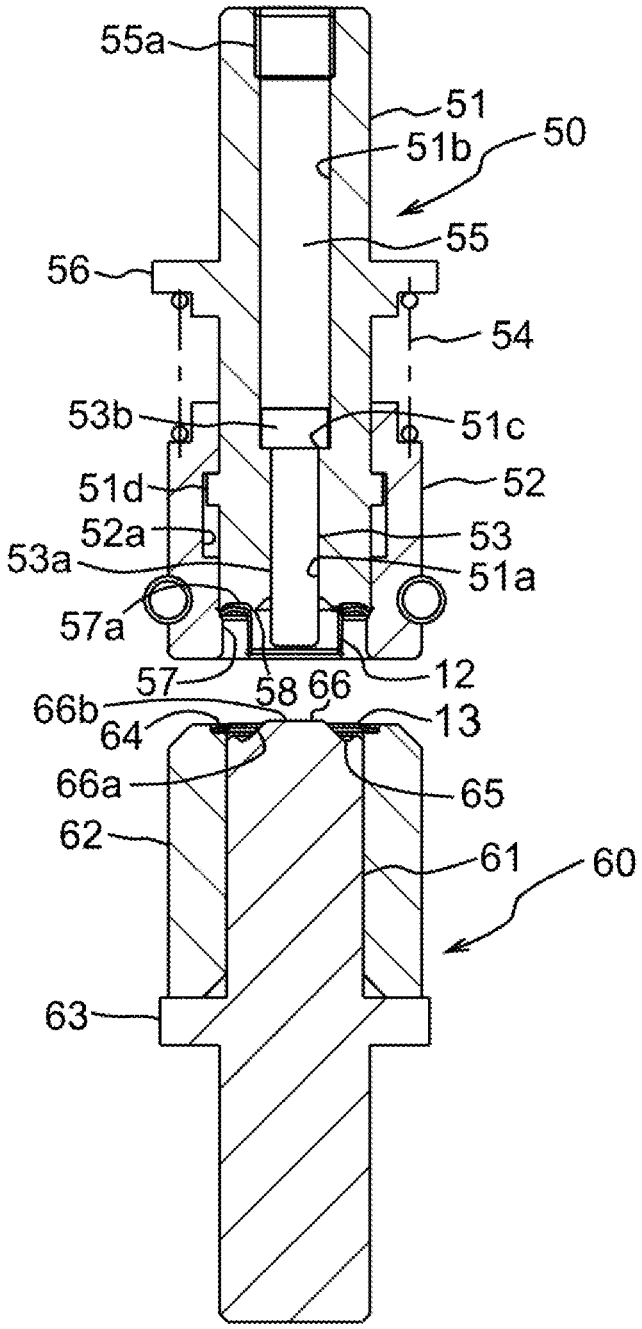

[FIG. 9]
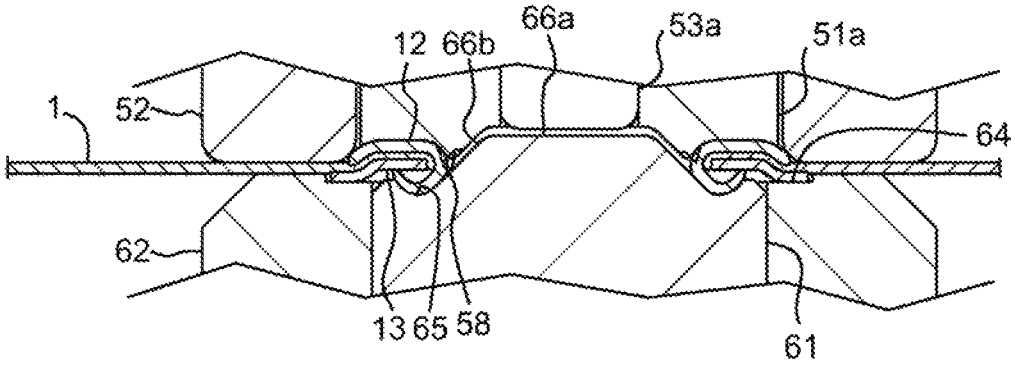

[FIG. 10]
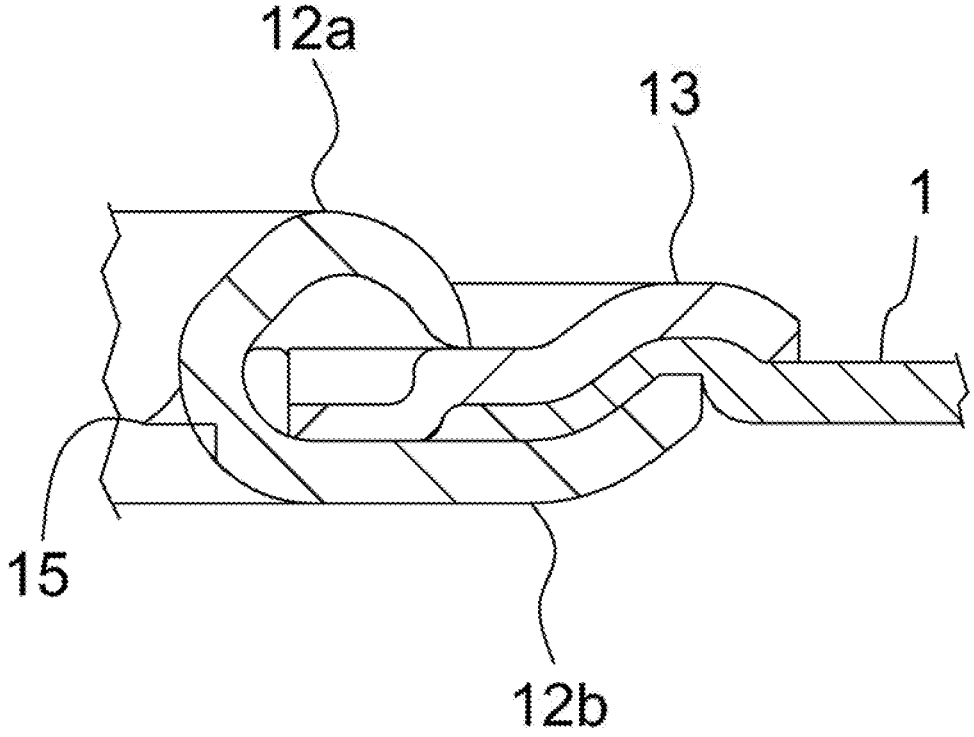

[FIG. 11]
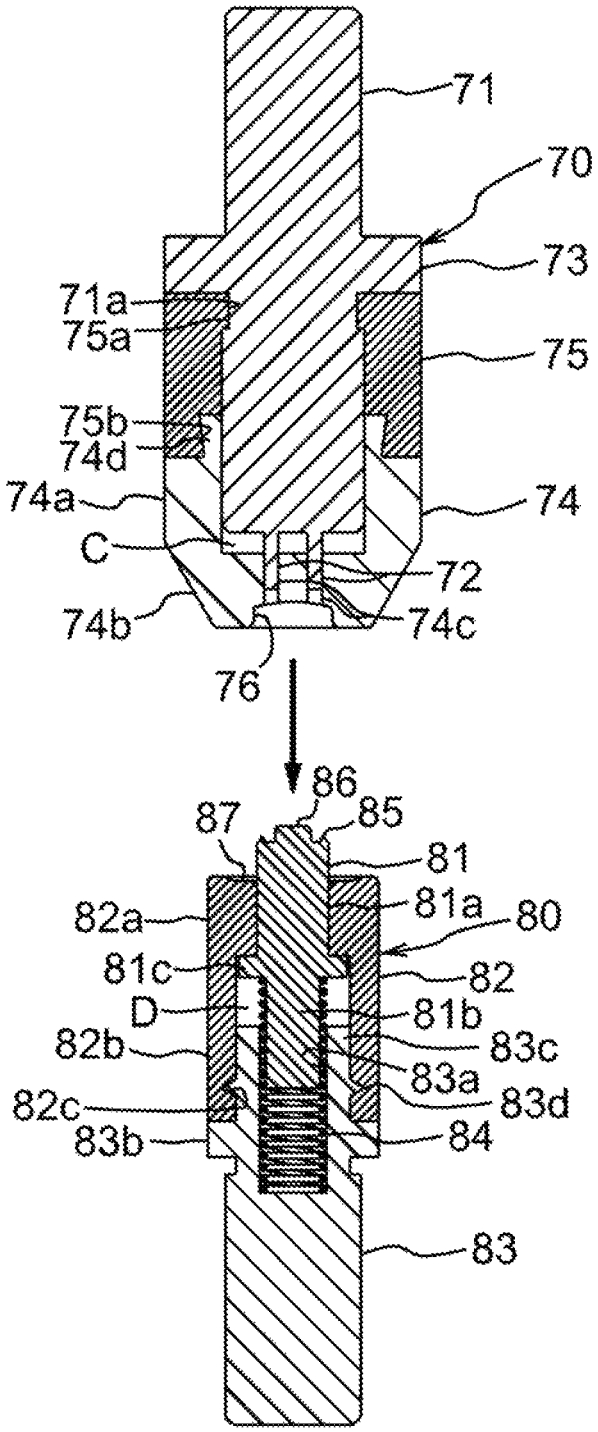

[FIG. 12]
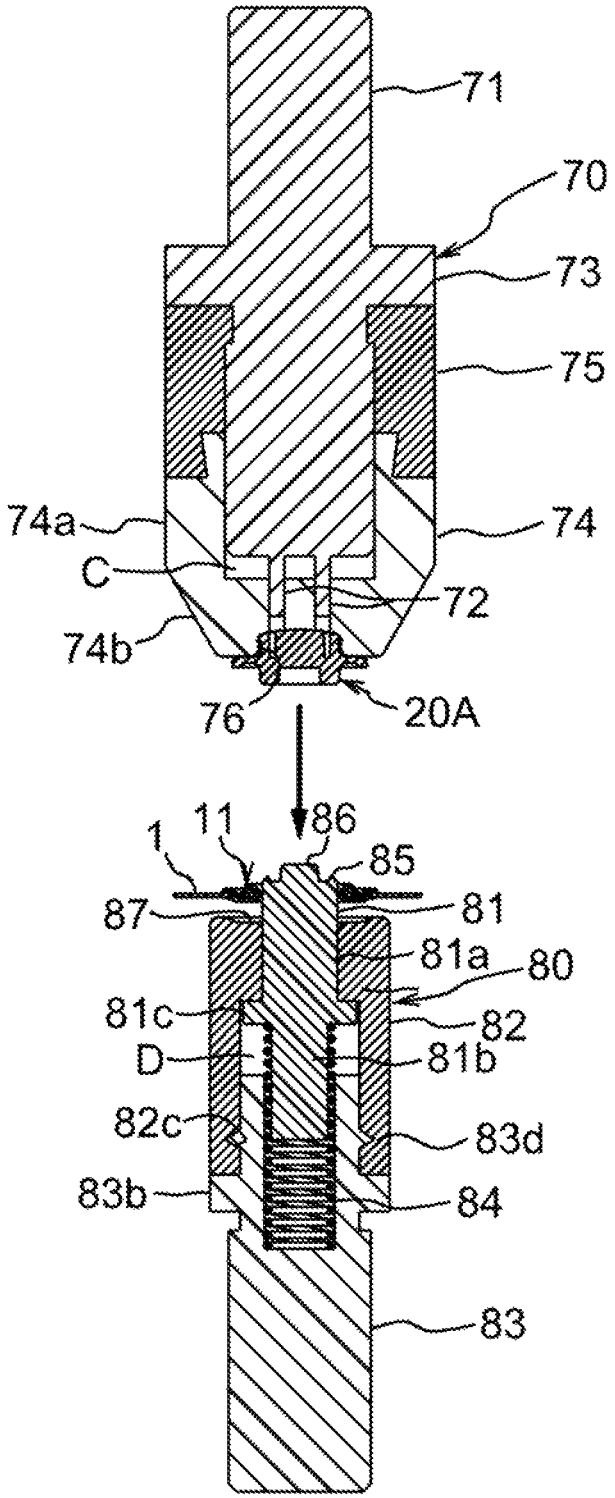

[FIG. 13]
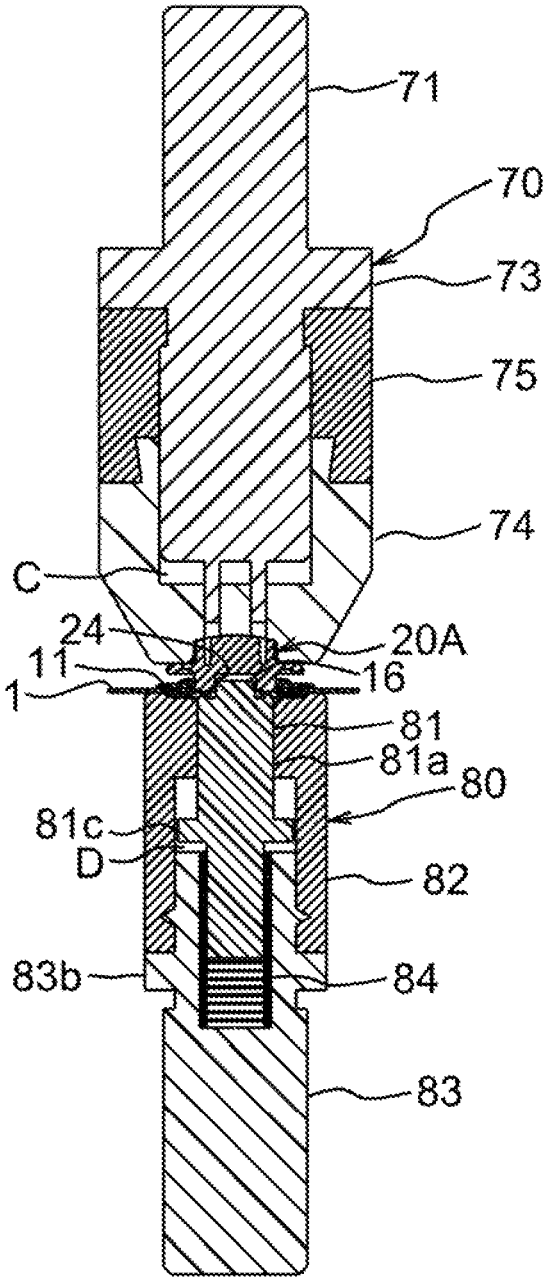

[FIG. 14]
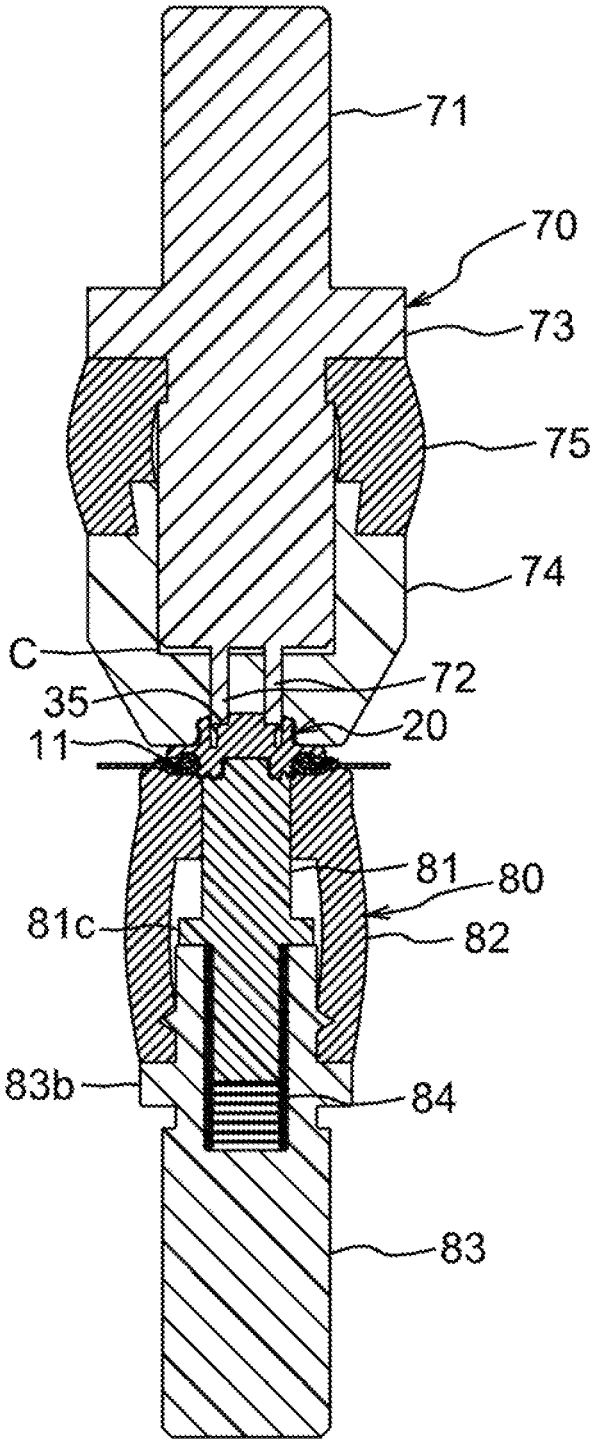

[FIG. 15]
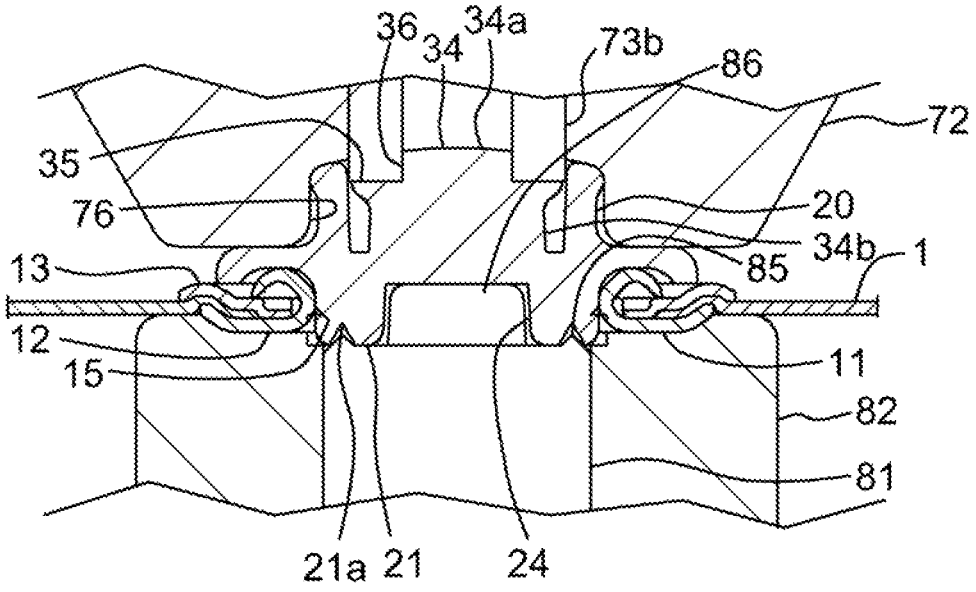

[FIG. 16]
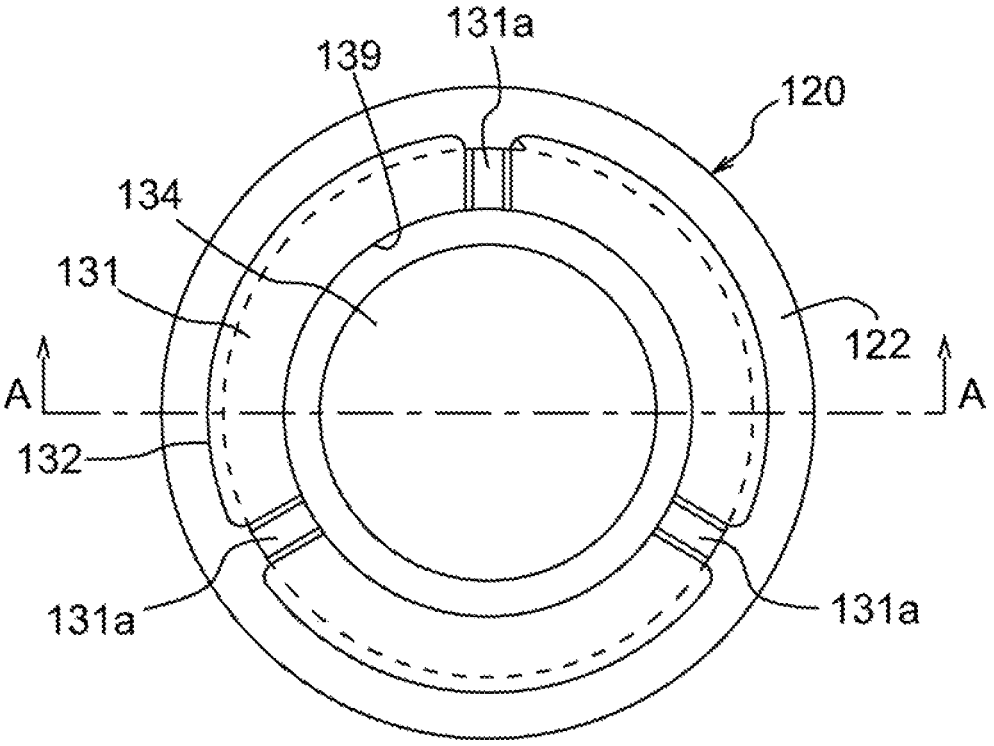

[FIG. 17]
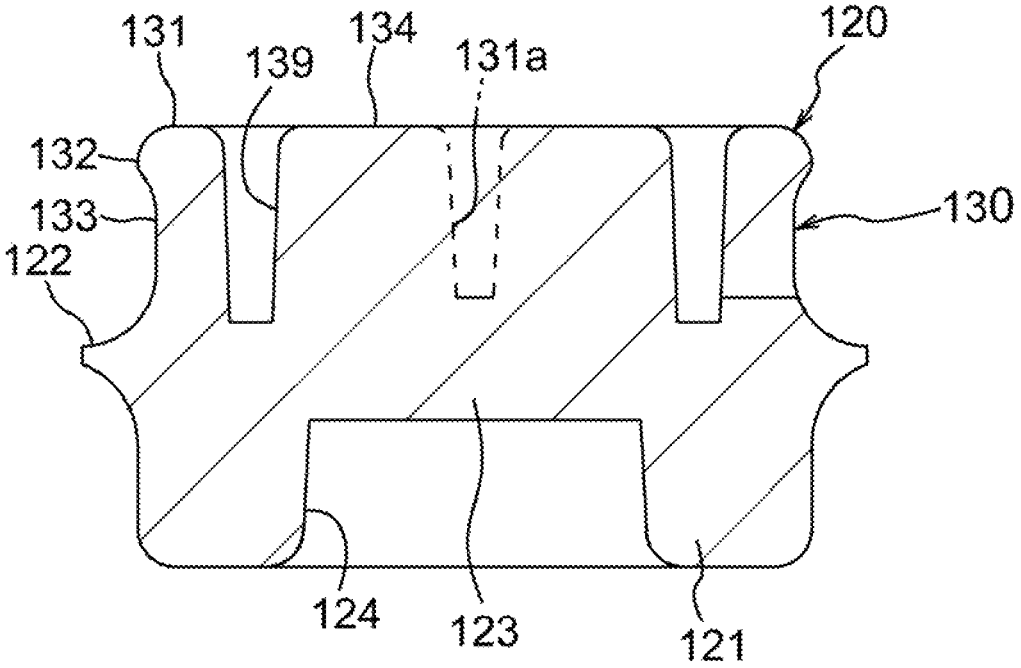

[FIG. 18]
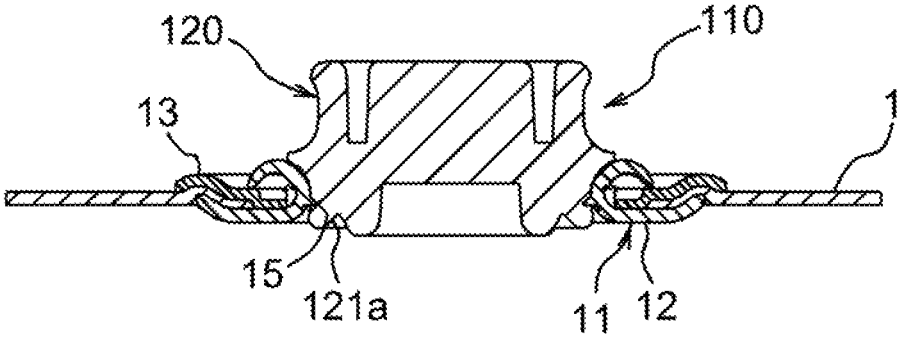

[FIG. 19]
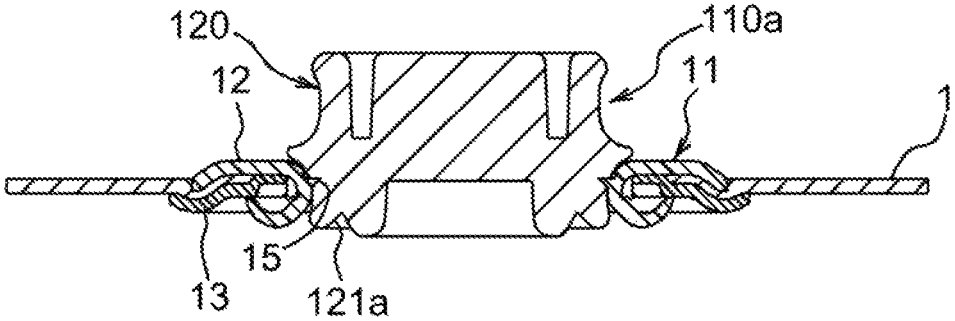

[FIG. 20]
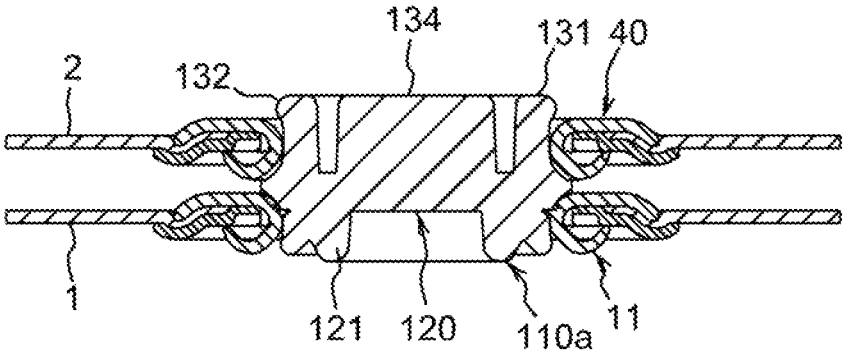

[FIG. 21]
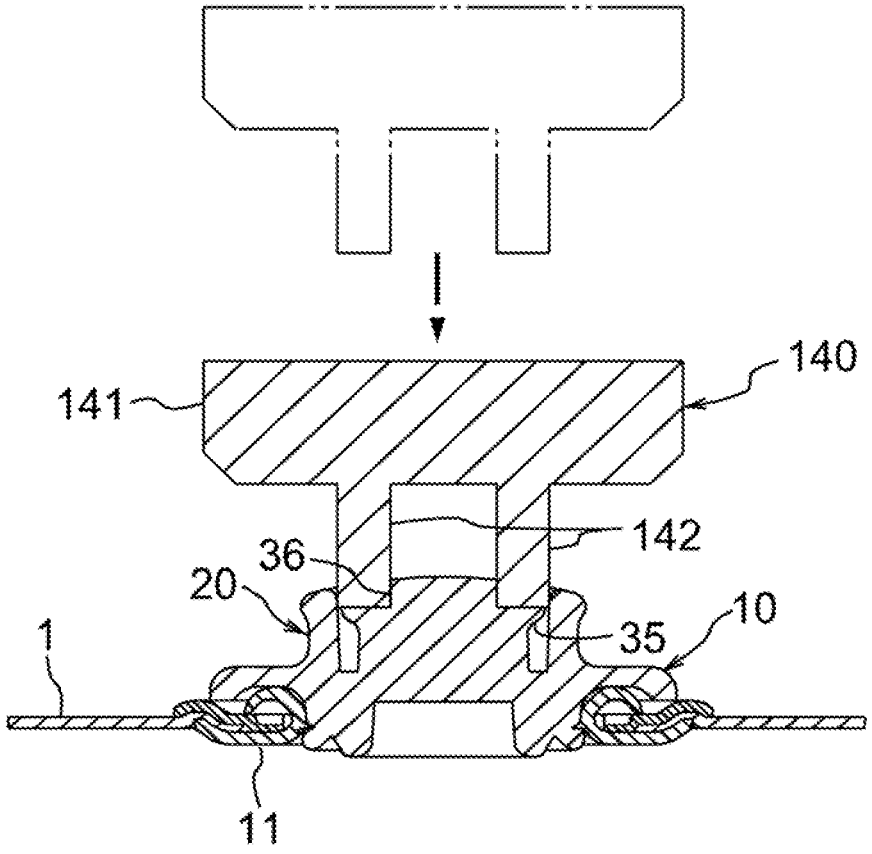

SNAP BUTTON AND MALE BODY FORMING METHOD

TECHNICAL FIELD

The present invention relates to a snap button and a method for forming a male snap. More particularly, it relates to a snap button that uses eyelet members for both a male snap and a female snap, and to a method for forming the male snap of such a snap button.

BACKGROUND ART

G 90 02 250.5 (Patent Document 1) discloses that an eyelet is used as a female snap of a snap button and a protruded portion of a male snap is engaged to and disengaged from an opening defined by the eyelet. Further, DE 2 117 612 (Patent Document 2) discloses that a pair of front and back engaging members are fixed to an opening of an eyelet to form a male snap; another eyelet is used as a female snap; and one of the engaging members on the front or back side of the male snap is engaged to and disengaged from an opening of the female snap.

However, the male snap of Patent Document 1 needs a separate stopper for attaching the male snap to a fabric. Therefore, the female and male snaps have different components between them, leading to decreased productivity. Further, when attaching the male snap to the fabric, it is necessary to swage (plastically deform) the stopper (or a part of the male snap). To provide the male snap with a strength capable of withstanding the swaging, it is necessary to increase the thickness (height) of the male snap to some extent. In Patent Document 2, there is a problem that the male snap is thick because the male snap bulges on front and back sides from the eyelet.

CITATION LIST

Patent Literatures

Patent Document 1: G 90 02 250.5
Patent Document 2: DE 2 117 612

SUMMARY OF INVENTION

Technical Problem

Thus, an object of the present invention is to provide a snap button that can increase the productivity and decrease the thickness, and to provide a method for forming a male snap of such a snap button.

Solution to Problem

To solve the above problems, an aspect of the present invention provides a snap button comprising a female snap and a male snap engageable with and disengageable from the female snap, wherein the female snap comprises a female eyelet member having an opening, wherein the male snap comprises a male eyelet member having an opening and an engaging member fixed to the opening of the male eyelet member, and wherein the engagement member comprises a connecting part connectable to and disconnectable from the opening of the female eyelet member, and a fixing part fitted into the opening of the male eyelet member.

In the snap button according to the present invention, the female snap comprises the female eyelet member, and the male snap comprises the male eyelet member and the engaging member fixed to the opening of the male eyelet member. The male engaging member is connected to and disconnected from the opening of the female snap, and thereby the male snap and the female snap are engaged to and disengaged from each other. In the present invention, it is possible to use a common eyelet member for the female eyelet member of the female snap and the male eyelet member of the male snap, thereby reducing the number of parts of the snap button and improving the productivity of the snap button. Further, since the female snap is formed as the female eyelet member, the female snap can be designed to be thin. Furthermore, when the male snap is attached to the fabric, the male eyelet member is attached to the fabric, and then the fixing part of the engaging member is fitted into the opening of the male eyelet member. Therefore, no separate stopper is required for attaching the male snap to the fabric. As a result, it is not necessary to provide the engaging member of the male snap with strength capable of withstanding the swaging of the stopper, so that it is possible to design the male snap to be thin accordingly. The fixing part of the engaging member can be fixed to the opening of the male eyelet member such as by press fitting or the like. In order to strengthen the fixing, protrusions or the like can be provided on the male eyelet member as described below. In the present invention, each of the male and female eyelet members may be composed of, for example, an eyelet body and a washer, but each of the members may be an eyelet member with no washer, for example.

In one embodiment of the present invention, the connecting part of the engaging member comprises includes a head portion having an outer diameter slightly larger than a diameter of the opening of the female eyelet member, and a neck portion having an outer diameter smaller than the outer diameter of the head portion. In this case, when the connecting part of the male engaging member is connected to and disconnected from the opening of the female snap, because of the outer diameter of the head portion of the connecting part being slightly larger than the opening of the female snap, the connecting part is temporarily elastically deformed radially inward and then restored radially outward. As will be described below, the connecting part can be made of resin or the like that can be elastically deformed as mentioned above. In this embodiment, the outer diameter of the neck portion of the connecting part may be set to be substantially the same as the diameter of the opening of the female snap.

In one embodiment of the present invention, the connecting part of the engaging member includes an elastically displaceable cylindrical portion having the head portion and the neck portion, and a post arranged radially inside the cylindrical portion, and wherein there is a gap between the cylindrical portion and the post. In this case, when the head portion of the cylindrical portion of the male snap passes through the opening of the female snap, the cylindrical portion is temporarily elastically deformed radially inward and then restored radially outward. In this embodiment, the gap(s) between the cylindrical portion and the post can facilitate the elastic displacement of the cylindrical portion in the radially inward direction. The gap(s) between the cylindrical portion and the post may be continuous in the circumferential direction, or may be discrete, multiple gaps at intervals in the circumferential direction.

In one embodiment of the present invention, the post of the connecting part of the engaging member includes, in the circumferential direction, a plurality of projections projecting radially outward. In this embodiment, when the head portion of the cylindrical portion of the male snap passes through the opening of the female snap as the male and female snaps are engaged to or disengaged from each other, the cylindrical portion is temporally elastically deformed radially inward. The radially inward elastic deformation of the cylindrical portion is restricted by contacting each of the projections of the post, in the regions of the cylindrical portion which correspond to the projections, in the circumferential direction, that project radially outward.

On the other hand, in the regions of the cylindrical portion which correspond to intervals between two projections adjacent in the circumferential direction, the radially inward elastic deformation of the cylindrical portion is relatively large without restriction by the projections. Thus, with the projections of the post, in the cylindrical portion, there are the regions where the radially inward, elastic deformation is relatively large and the regions where the radially inward, elastic deformation is relatively small, alternately in the circumferential direction. This makes it possible to desirably adjust a force required for engagement and disengagement between the male and female snaps or strength against transverse tensile force acting on the male snap engaged with the female snap, by changing the number, shape or the like of the plurality of the projections circumferentially provided on the post of the connecting part. A step of forming the projections on the post can be performed at the time when the engaging member is fixed to the male eyelet member attached to a fabric, or before or after the engaging member is fixed to the male eyelet member.

In an embodiment of the present invention, the male eyelet member includes a plurality of protrusions in the circumferential direction, the protrusions each projecting radially inward from an inner peripheral surface defining the opening of the male eyelet member. In this case, when the fixing part of the engaging member is fixedly fitted into the opening of the male eyelet member, the plurality of protrusions of the male eyelet member can bite into the fixing part, strengthening the fixing between the male eyelet member and the engaging member. To facilitate the biting of the protrusions into the fixing part, when the fixing part of the engaging member is fixed to the opening of the male eyelet member, the fixing part can be swaged such that a radially outer portion of the fixing part is pushed radially outward to be pressed against the protrusions of the male eyelet member, for example.

In an embodiment of the present invention, the fixing part of the engaging member is cylindrical, and there is a space radially inside the engaging member, the space opening axially opposite to the connecting part. In this case, when the fixing part of the engaging member is fitted into the opening of the male eyelet member, the fixing part is easily elastically deformed radially inward because of the fixing part being cylindrical. This allows the fixing part having the outer diameter larger than that of the opening of the male eyelet member to be easily press-fitted into the opening. Further, in a step of fixing the fixing part to the opening of the male eyelet member, the space radially inside the fixing part can facilitate the centering of the fixing part, such as by matching a projected part of a die to the space.

In one embodiment of the present invention, the thickness of the fixing part along the radial direction is thicker than the thickness of the cylindrical portion along the radial direction. In this case, the radially elastic deformation capability of the fixing part is lower than that of the cylindrical portion. This makes it difficult for the fixing part to be removed from the opening of the male eyelet member, while making it easy to design the cylindrical portion to be connectable to and disconnectable from the opening of the female eyelet member.

In one embodiment of the present invention, the female eyelet member is made of metal and the engaging member is made of resin. In this case, there is substantially no noise which can be generated when the engaging member of the male snap is engaged to or disengaged from the female snap and when both of the former and the latter are made of metal or resin, enhancing low-noise capability. As examples of metal for the female eyelet member, copper, copper alloy, aluminum, aluminum alloy, nickel, nickel alloy, titanium, titanium alloy, stainless steel, iron, or the like can be cited, but not limited thereto. As examples of resin for the engaging member, thermosetting resin, thermoplastic resin, or the like can be cited, and more particularly, engineering plastic such as polyacetal and heat-resistant nylon (polyamides) can be preferably cited, but not limited thereto.

Another aspect of the present invention provides a method for forming a male snap, which comprises a male eyelet member having an opening and an engaging member to be fixed to the opening of the male eyelet member, the engaging member comprising a connecting part connectable to and disconnectable from an opening of a female eyelet member, and a fixing part fitted into the opening of the male eyelet member, the method comprising: a step A of attaching the male eyelet member to a fabric; and a step B of fixing the fixing part of the engaging member to the opening of the male eyelet member attached to the fabric, wherein the step A includes forming, on the male eyelet member, a plurality of protrusions in the circumferential direction, each of which projects radially inward from an inner peripheral surface defining the opening of the male eyelet member.

In the present invention, at the time when the male eyelet member is attached to the fabric, the plurality of protrusions projecting radially inward from the inner peripheral surface defining the opening of the male eyelet member are formed in the circumferential direction. Thereby, in the step B, when the fixing part of the engaging member is fitted into the opening of the male eyelet member, the protrusions of the male eyelet member can bite into the fixing part, so that the engaging member can be reliably fixed to the opening of the male eyelet member. In order to form such protrusions on the male eyelet member, for example, it is possible to provide edges for forming the protrusion on an eyelet attaching die.

In the present invention, the step B may include pressing a radially outer portion of the fixing part of the engaging member against the protrusions. In this case, when the fixing part of the engaging member is fixed to the opening of the male eyelet member that has been attached to the fabric, the radially outer portion of the fixing part is pressed against the protrusions of the eyelet member, so that the protrusions surely bite into the fixing part. This can lead to further secure fixing of the engaging member to the opening of the male eyelet member.

Still another aspect of the present invention provides a method for forming a male snap, which comprises a male eyelet member having an opening and an engaging member to be fixed to the opening of the male eyelet member, the engaging member comprising a connecting part connectable to and disconnectable from an opening of a female eyelet member, and a fixing part fitted into the opening of the male eyelet member, the connecting part of the engaging member including an elastically displaceable cylindrical portion and a post arranged radially inside the cylindrical portion with a gap between the cylindrical portion and the post, the method comprising: a step A of attaching the male eyelet member to a fabric; and a step B of fixing the fixing part of the engaging member to the opening of the male eyelet member attached to the fabric, wherein the step B includes forming a plurality of projections projecting radially outward on the post in the circumferential direction.

In the present invention, at the time when the fixing part of the engaging member is fixed to the opening of the male eyelet member that has been attached to the fabric, the plurality of projections projecting radially outward in the circumferential direction are formed on the post of the connecting part of the engaging member. By simultaneously fixing the engaging member to the eyelet member and forming the projections on the post of the connecting part, the productivity of the male snap can be improved as compared with a case where these steps are separately carried out. The forming of the projections on the post can be carried out by means of a dedicated punch die (see e.g. FIG. 12), for example.

Advantageous Effects of Invention

In the snap button according to the present invention, it is possible to use a common eyelet member for the female eyelet member of the female snap and the male eyelet member of the male snap, thereby reducing the number of parts of the snap button and improving the productivity of the snap button. Further, by forming the female snap as the female eyelet member, the female snap can be designed to be thinner. Furthermore, the attachment of the male snap to the fabric is carried out by attaching the male eyelet member to the fabric and fixedly fitting the fixing part of the engaging member into the opening of the male eyelet member. Therefore, it is not necessary to use a separate stopper for attaching the male snap to the fabric. As a result, it is not necessary to provide the engaging member of the male snap with strength capable of withstanding the swaging of the stopper, so that the male snap can be designed to be thinner accordingly.

In the method for forming the male snap according to the present invention, when the male eyelet member is attached to the fabric, the plurality of protrusions, in the circumferential direction, projecting radially inward from the inner peripheral surface defining the opening of the male eyelet member are formed. Thereby, when the fixing part of the engaging member is fitted into the opening of the male eyelet member, the protrusions of the male eyelet member can bite into the fixing part, and thereby the engaging member is securely fixed to the opening of the male eyelet member. In this case, a special attaching tool (spike die) that is separate from a male snap attaching tool is required.

In another method for forming the male snap according to the present invention, by simultaneously fixing the engaging member to the eyelet member and forming the projections on the post of the connecting part, the productivity of the male snap can be improved as compared with a case where these steps are separately carried out. Such a configuration of the male snap is advantageous for improving the productivity and making the attachment to the fabric easier, particularly when the engaging member is made of resin and the male eyelet member is made of metal.

BRIEF DESCRIPTION OF DRAWINGS

FIG. 1 is a cross-sectional explanatory view showing a male snap attached to a fabric.

FIG. 2 is a cross-sectional explanatory view showing a female snap attached to a fabric.

FIG. 3 is a cross-sectional explanatory view showing a state where the male snap has been connected to the female snap.

FIG. 4 is a cross-sectional explanatory view showing a male eyelet member attached to a fabric and an engaging member (an initial engaging member) immediately before being fixed to the male eyelet member and before forming projections.

FIG. 5 is a top view of the male eyelet member of FIG. 4.

FIG. 6 is a cross-sectional explanatory view showing arrangement states of an eyelet body and a washer immediately before attachment to a fabric.

FIG. 7 is an explanatory top view of an engaging member showing an initial engaging member having no projection in the left half part and an engaging member having projections in the right half part.

FIG. 8 is a cross-sectional explanatory view schematically showing an upper die and a lower die which are used for attaching a male eyelet member to a fabric.

FIG. 9 is an enlarged cross-sectional explanatory view showing a step of attaching a male eyelet member to a fabric between an upper die and a lower die while forming protrusions on the male eyelet member with the upper die.

FIG. 10 is an enlarged cross-sectional explanatory view of a male eyelet member provided with protrusions on an inner peripheral surface.

FIG. 11 is a cross-sectional explanatory view schematically showing an upper die and a lower die which are used in a step of fixing an initial engaging member to an eyelet member attached to a fabric while creating projections on the initial engaging member.

FIG. 12 is a cross-sectional explanatory view schematically showing a state immediately before holding an initial engaging member by the upper die of FIG. 11 and setting an eyelet member to the lower die.

FIG. 13 is a sectional explanatory view showing a state where an upper die has pressed down a die body of a lower die via an initial engaging member.

FIG. 14 is a cross-sectional explanatory view showing a state where the die body of the upper die has further descended from the time point of FIG. 13.

FIG. 15 is a partially enlarged view of FIG. 14.

FIG. 16 is a top view showing a variation of an engaging member of a male snap.

FIG. 17 is a sectional view taken along the line A-A in FIG. 16.

FIG. 18 is a cross-sectional explanatory view showing a male snap including the engaging member of FIG. 16.

FIG. 19 is a cross-sectional explanatory view showing a male snap to an eyelet member in which the engaging member of FIG. 16 has been vertically inverted.

FIG. 20 is a sectional explanatory view showing a state where the male snap of FIG. 19 has been connected to a female snap.

FIG. 21 is a cross-sectional explanatory view schematically showing a measuring tool for determining the quality of projections of an engaging member.

DESCRIPTION OF EMBODIMENTS

Hereinafter, preferable embodiments of the present invention will be described. However, the present invention is not limited to such embodiments, and modifications and the like may be suitably made within the scope of claims and the range of the equivalents. FIG. 1 is a cross-sectional explanatory view showing a male snap 10 attached to a fabric 1 such as an inner breast of a garment. FIG. 2 is a cross-sectional explanatory view showing a female snap 40 attached to a fabric 2 such as an outer breast of the garment. The female snap 40 can be engaged to and disengaged from the male snap 10. FIG. 3 is a cross-sectional explanatory view showing a state where the male snap 10 is connected to the female snap 40. It should be noted that, in the following descriptions, an up-and-down direction is based on each sheet of FIGS. 1 to 3, etc. The male snap 10 comprises a metallic male eyelet member 11 (hereinafter also simply referred to as "eyelet member 11") which is directly attached to the fabric 1, and an engaging member 20, which is a resin molded product and is fixed to the eyelet member 11 that has been attached to the fabric 1. In this embodiment, the engaging member 20 is made of an engineering plastic such as polyacetal and heat-resistant nylon (polyamide), but it is not limited thereto. The eyelet member 11 is composed of an eyelet body 12 including a cylindrical portion 12*a*, and an annular washer 13 having a circular hole 13*a* through which the cylindrical portion 12*a* passes.

FIG. 4 is a cross-sectional explanatory view showing the eyelet member 11 attached to the fabric 1 and an initial engaging member 20A, which corresponds to the engaging member 20 immediately before being fixed to the eyelet member 11 and before forming projections 35 (FIG. 1) as described below. FIG. 5 is a top view of the eyelet member 11 of FIG. 4, in which the fabric 1 is omitted. Although a step of attaching the eyelet member 11 to the fabric 1 will be described below, during this step the cylindrical portion 12*a* of the eyelet body 12 pierces the fabric 1; then passes through the hole 13*a* of the washer 13; and is then swaged by a die as described below (see a lower die 60 in FIG. 9; it should be noted that in FIG. 9 the upper and lower arrangements of the eyelet body 12 and the washer 13 are reversed relative to those in FIG. 6, etc.) so as to be curved radially outwardly in a C shape. Thereby, the eyelet member 11 is fixed to the fabric 1, and the curved cylindrical portion 12*a* of the eyelet body 12 defines a circular opening 14 passing through the fabric 1 in the up-and-down direction. The eyelet member 11 has eight protrusions 15 as an example at equal intervals in the circumferential direction on the inner peripheral surface of the cylindrical portion 12*a*. As can be seen from FIG. 5, etc., each protrusion 15 has a rectangular shape as viewed in the plan; protrudes radially inward from the inner peripheral surface of the curved cylindrical portion 12*a* that defines the opening 14; and has a thickness, in the up-and-down direction, decreasing radially inward to be sharp. As will be described below in detail, each protrusion 15 is formed by an upper die 50 (see detailed views of FIGS. 8, 9, etc.) when the eyelet 11 is attached to the fabric 1. Also, as will be described below, the engaging member 20 (the initial engaging member 20A) is fixed to the opening 14 of the eyelet member 11 in order for the engaging member 20 not to be detached from the opening 14.

FIG. 6 is a cross-sectional explanatory view showing an arrangement state of the eyelet body 12 and the washer 13 immediately before they are attached to the fabric 1. The eyelet body 12 includes the above cylindrical portion 12*a* and a flange portion 12*b* extending radially outward from the lower end of the cylindrical portion 12*a*. The radially outer end of the flange portion 12*b* is obliquely bent radially outward and upward. The washer 13 includes an inner portion 13*b* defining the hole 13*a* and an outer portion 13*c* slightly rising in a stepped manner from the radially outer end of the inner portion 13*b* and then extending radially outward. The radially outer end of the outer portion 13*c* is curved so as to be slightly convex upward. Referring to FIG. 4, the eyelet member 11 attached to the fabric 1 sandwiches the fabric 1 between the upper surface of the flange portion 12*b* of the eyelet body 12 and the lower surface of the washer 13. On the upper surface of the flange portion 12*b* and on the lower surface of the washer 13, which will be in contact with the fabric 1, a cushioning coating material may be applied in advance. With such a cushioning coating material, it is possible to prevent an event that the fabric 1 is cut by the edge of the flange portion 12*b* or the washer 13, or the fabric 1 is pulled to be detached from the eyelet member 11. The cushioning coating material is preferably a urethane base coating material, but not limited to.

Referring to FIG. 2, the female snap 40 comprises a female eyelet member 40 (hereinafter also simply referred to as "eyelet member 40"), which is the same member as the male eyelet member 11 of the male snap 10, with the exception that there are no projections 15. For convenience of explanation, the same reference numeral 40 is used in both the female snap and the female eyelet member. The female snap 40 composes an eyelet body 42, which is the same as the eyelet body 12 of the male eyelet member 11, and a washer 43, which is the same as the washer 13. Between the eyelet body 42 of the female snap 40 and the eyelet body 12 of the male eyelet member 11, there is only difference that the protrusions 15 are not formed on the eyelet body 42. The female eyelet member 40 defines a circular opening 41 passing through the fabric 2.

Referring to FIG. 1, the engaging member 20 of the male snap 10 includes an upper connecting part 30 connectable to and disconnectable from the opening 41 of the female snap 40; a lower fixing part 21 to be fixed into the opening 14 of the eyelet member 11; a flange 22 extending radially outward between the connecting part 30 and the fixing part 21; and a base 23 between the connecting part 30 and the fixing part 21 and radially inward from the flange 22. The connecting part 30 includes a cylindrical portion 31 extending upward from the base 23 and a post 34 that protrudes upward from the base 23 and is located radially inside the cylindrical portion 31. Between the cylindrical portion 31 and the post 34, there is an annular gap 39 that opens upward. The cylindrical portion 31 is elastically deformable radially inward when the male snap 10 is engaged to and disengaged from the female snap 40. An upper surface 34*a* of the post 34 is positioned slightly above the upper end of the cylindrical portion 31 and is a curved surface that is slightly convex upward. The cylindrical portion 31 includes a head portion 32 that is an upper end portion having a relatively larger outer diameter; and a neck portion 33 having a slightly smaller outer diameter than the head portion 32. The inner diameter of the cylindrical portion 31 is substantially constant. In the initial state of the male snap 10 as shown in FIG. 1, the outer diameter of the head portion 32 of the cylindrical portion 31 is set to be slightly larger than the diameter of the opening 41 of the female snap 40, and the outer diameter of the neck portion 33 is set to be substantially equal to or slightly smaller than the diameter of the opening 41 of the female snap 40. As a result, when the male snap 10 is engaged to and disengaged from the female snap 40, the cylindrical portion 31 is temporarily elastically deformed radially inward, and immediately after that it is restored radially outward, as the head portion 32 of the cylindrical portion 31 of the male snap 10 passes through the opening 41 of the female snap 40.

The post 34 of the connecting part 30 of the male snap 10 includes six projections 35 at regular intervals in the circumferential direction, as an example, each of projections 35 protruding radially outward. The number of the projections 35 may be from 0 to 24 or more, and can be varied depending on types of the fabric 1 or objects (bags, wallets, tents, clothes, etc.) to be used. Each projection 35 (and each hollow 36 as described below) is formed by means of a special die (see an upper die 70 in FIG. 11) as described below on the initial engaging member 20A (see FIG. 4). In the present embodiment, a step of creating the projections 35 on the initial engaging member 20A is carried out simultaneously with a step of fixing the initial engaging member 20A to the eyelet member 11 that has been attached to the fabric 1 as described below. However, the creating of the projections 35 on the initial engaging member 20A can be carried out before or after the initial engaging member 20A is fixed to the eyelet member 1. The gap 39 between the cylindrical portion 31 and the post 34 is needed as a space for removing a mold when the elastically deformable cylindrical portion 31 of the connecting part 30 is molded. If the gap 39 is used as it is without providing the projections 35 on the post 34, the cylindrical portion 31 would be more easily deformable. Therefore, in the state where the male snap 10 and the female snap 40 are connected, the connecting strength between the male and female snaps 10, 40 can be relatively weak against a lateral pulling force acting on the male snap 10 through the fabric 1 (or on the female snap 40 through the fabric 2). In order to improve the connecting strength, by forming the projections 35 on the post 34 such that the projections 35 occupy a part of the gap 39, the quantity of elastic deformation of the cylindrical portion 31 can be adjusted and the connecting strength against the lateral pulling can be enhanced.

FIG. 7 is an explanatory top view showing the initial engaging member 20A with no projections 35 on the left half side and the engaging member 20 with the projections 35 on the right half side. It should be noted that since the initial engaging member 20A and the engaging member 20 are "substantially the same" except for the projections 35 and hollows 36 as described below, the same reference numerals are used in the members 20A, 20 except for the projections 35 and the hollows 36. In other words, the engaging member 20 before creating the projections 35 is the initial engaging member 20A. In FIG. 1, on the lower surface of the fixing part 21 of the engaging member 20 fixed to the eyelet member 11, there is a swaged mark 21*a* as described below. If the initial engagement member 20A is first attached to the eyelet member 11 and then the projections 35 are formed on the post 34 of the connecting part 30, the swaged mark 21*a* will be generated on the fixing part 21 of the initial engaging member 20A. Each of the projections 35 protrudes radially outward from the outer peripheral surface 34*b* of the post 34 in a substantially semicircular shape as viewed from the top. The radially outer end of each of the projections 35 is close to the inner peripheral surface of the cylindrical portion 31, or may be in contact with the inner peripheral surface. The upper surface of each of the projections 35 is a substantially horizontal plane and is located in the substantially middle in the up-and-down direction between the upper surface 34*a* of the post 34 and the middle of the post 34. The thickness of each of the projections 35 in the up-and-down direction becomes thinner radially outward from its radially inner end along the outer peripheral surface 34*b* of the post 34. An upper space above each of the projections 35, namely, circumferentially corresponding to each of the projection 35 in the post 34 forms a hollow 36, which is depressed from the upper surface 34*a* and the outer peripheral surface 34*b* of the post 34. Each hollow 36 is depressed radially inward from the outer peripheral surface 34*b* of the post 34 in a substantially semicircular shape as viewed from the top. A lower surface of each hollow 36 is substantially horizontal and the same with the upper surface of each projection 35.

The fixing part 21 of the engaging member 20 of the male snap 10 protrudes downward from the base 23 in a cylindrical shape. There is a space 24 radially inside the fixing part 21, and the space 24 opens downward. The thickness of the fixing part 21 along the radial direction is about twice the thickness of the cylindrical portion 31 of the connecting part 30 along the radial direction. The outer diameter w of the fixing part 21 (see FIG. 4) is preferably set to be equal to or slightly larger than the diameter w1 of the opening 14 of the eyelet member 11 (see FIG. 5). If the outer diameter w of the fixing part 21 is slightly larger than the diameter w1 of the opening 14, the fixing part 21 of the engaging member 20 can be pressed into the opening 14 of the eyelet member 11. The thickness of the fixing part 21 along the radial direction is thicker than that of the cylindrical portion 31. Therefore, the fixing part 21 is less elastically deformable than the cylindrical portion 31. This makes it possible to increase the connecting strength of the fixing part 21 to the opening 14 of the eyelet member 11 by press fitting. The distance w2 between two protrusions 15 of the eyelet member 11 along a diameter (see FIG. 5) is slightly smaller than the diameter w1 of the opening 14. That is, $w2<w1\leq w$. Therefore, even if the outer diameter w of the fixing part 21 is equal to the diameter w1 of the opening 14, the fixing part 21 can be press-fitted into at least between the protrusions 15 of the opening 14. When the fixing part 21 is press fitted, the protrusions 15 bite into the outer peripheral surface of the fixing part 21 while being elastically displaced radially outward and then elastically restored radially inward. With the protrusions 15 of the eyelet member 11 biting into the outer peripheral surface of the fixing part 21, the fixing part 21 of the engaging member 20 is securely connected to the opening 14 of the eyelet member 11. In addition, during the fixing of the engaging member 20 to the eyelet member 11, a protruded portion 85 (see FIG. 12) of a center guide pin 81 of a lower die 80 as described below is allowed to bite into the lower surface of the fixing part 21 so as to swage (plastically deform) the fixing part 21 such that the radially outer portion of the fixing part 21 is displaced radially outward. As a result, the outer peripheral surface of the fixing part 21 is pressed against the protrusions 15 of the eyelet member 11, the protrusions 15 further bite into the fixing part 21, and the fixing part 21 of the engaging member 20 is further securely fixed to the opening 14 of the eyelet member 11. On the lower surface of the fixing part 21, there remains one or more annular swaged marks 21*a*, which are recessed upward. The swaged marks 21*a* are formed by the protruded portion 85 of the center guide pin 81 biting into the lower surface of the fixing part 21. The flange 22 of the engaging member 20 has a recess 22*a* that is concave upward, below the lower surface thereof. The flange 22 receives the cylindrical portion 12*a* of the eyelet body 12 in the recess 22*a* after the engaging member 20 is fixed to the eyelet member 11. In an example of the initial engaging member 20A shown in FIG. 4, the outer diameter w of the fixing part 21 is constant, but the present invention is not limited thereto and the outer diameter of the fixing part 21 may be formed so as to gradually decrease downward. Even if the outer diameter w of the fixing part 21 is set to be smaller than the diameter w1 of the opening 14 of the eyelet member 11, the relationship $w2<w\leq w1$ is satisfied. Also in this case, the fixing part 21 of the engaging portion 20 can be connected to the opening 14 of the eyelet member 11 because the fixing part 21 is at least press-fitted among the protrusions 15 of the opening 14 and the protrusions 15 of the eyelet member 11 bite into the outer peripheral surface of the fixing part 21.

FIG. 8 is a cross-sectional explanatory view schematically showing an upper die 50 and a lower die 60, which are used when the eyelet member 11 of the male snap 10 is attached to the fabric 1. When the eyelet member 11 is attached to the fabric 1, the eyelet body 12 is held on the upper die 50 and the washer 13 is set on the lower die 60. This upper and lower arrangement of the eyelet body 12 and washer 13 is reversed from the upper and lower arrangement shown in FIG. 6. It should be noted that the upper and lower dies herein are merely examples, and the upper and lower dies may be reversed, or the two dies may be arranged horizontally. Also, hereinafter, an example will be described in which the upper die 50 moves up and down with respect to the stationary lower die 60, but the lower die may move up or both of the upper and lower dies may move. The same is true of an upper die 70 and a lower die 80 as described below. The upper die 50 includes a cylindrical die body 51 having an inner cavity; a sleeve 52 disposed around a lower portion of the die body 51; and a cylindrical fabric pressing member 53 housed in a lower portion (a small diameter portion 51*a*) of the inner cavity in the die body 51. The sleeve 52 is biased downward by a spring 54 relative to the die body 51. Further, the fabric pressing member 53 is biased downward by a spring 55 relative to the die body 51. The spring 55 is housed in an upper portion (a large diameter portion 51*b*) of the inner cavity in the die body 51. The sleeve 52 has a dent 52*a* that is recessed, in a rectangular shape, radially outward from the inner peripheral surface of the sleeve 52. The die body 51 has a convex stopper 51*d* that protrudes radially outward from the outer peripheral surface of the die body 51. The stopper 51 is received in the dent 52*a* of the sleeve 52. The sleeve 52 being biased downward by the spring 54 is restricted in further moving downward displacement relative to the die body 51 by the upper face of the dent 52*a* contacting the stopper 51*d*. The upper end of the spring 54 is received by a spring seat 56 that projects radially outward from the outer peripheral surface of the die body 51. The inner cavity of the die body 51 opens at the upper and lower ends of the die body 51, and is divided into a lower small diameter portion 51*a* and a large diameter portion 51*b*, which is located above the small diameter portion 51*a*. The diameter of the large diameter portion 51*b* is slightly larger than that of the small diameter portion 51*a*. At the boundary between the small diameter portion 51*a* and the large diameter portion 51*b*, there is a stepped portion 51*c*. The fabric pressing member 53 includes a columnar fabric pressing body 53*a* housed in the small diameter portion 51*a*; and a disc-shaped proximal portion 53*b* connected to the upper end of the fabric pressing body 53*a* and housed in the large diameter portion 51*b*. The outer diameter of the proximal portion 53*b* is larger than the diameter of the small diameter portion 51*a*. The upper end of the spring 55 is received by the spring seat 55*a* fixed to the upper end of the large diameter portion 51*b*. The fabric pressing member 53 being biased downward by the spring 55 relative to the die body 51 is restricted in further downward displacement by the proximal portion 53*b* contacting the stepped portion 51*c*.

The upper die 50 shown in FIG. 8 is in the initial state. In this initial state, the sleeve 52 is at its lowermost position relative to the die body 51, where downward displacement of the sleeve 52 with respect to the die body 51 is restricted by the stopper 51*d*. The sleeve 52 at the lowermost position protrudes below the lower end of the die body 51. Further, in the initial state, the fabric pressing member 53 is its lowermost position relative to the die body 51, where downward displacement of the fabric pressing member 53 relative to the die body 51 is restricted by the proximal portion 53*b* contacting the stepped portion 51*c* of the die body 51. The fabric pressing body 53*a* at the lowermost position protrudes below the lower end of the die body 51. The lower end of the sleeve 52 is located at substantially the same vertical level as the lower end of the cylindrical portion 12*a* of the eyelet body 12 that is held by an eyelet holding portion 57 at its lowermost position as described below. The lower end of the fabric pressing member 53 at its lowermost position is slightly above the lower end of the sleeve 52.

The upper die 50 includes the eyelet holding portion 57 for holding the eyelet body 12, and the eyelet holding portion 57 is defined by the lower end of the die body 51 and the inner peripheral surface of the portion, of the sleeve 52 at its lowermost position, which projects below the lower end of the die body 51. The lower end of the die body 51 is provided with a flange receiving portion 57*a* that substantially conforms to the flange portion 12*b* of the eyelet body 12 and is annularly slightly recessed upward; and eight protrusion forming edges (spikes) 58 at the radially inner end of the flange receiving portion 57*a* in the circumferential direction, for forming the protrusions 15 on the inner surface of the cylindrical portion 12*a*. It should be noted that the upper die 50 and the lower die 60 can also be used when the female snap (the female eyelet member) 40 is attached to the fabric 2. In this case, an upper die with no protrusion forming edges (spikes) 58 is used. The lower end of the die body 51 is inclined upward and radially inward from the radially inner end (the protrusion forming edges 58) of the flange receiving portion 57*a*. The lower end of the die body of a normal die with no protrusion forming edges 58 is inclined upward and radially inward from the radially inner end of the flange receiving portion 57*a*. The diameter of the flange portion 12*b* of the eyelet body 12 is slightly larger than the inner diameter of the sleeve 52. Thereby, the eyelet body 12 can be held by the flange holding portion 57 by means of friction between the radially outer end of the flange portion 12 and the inner peripheral surface of the sleeve 52. At this time, the flange portion 12*b* is received in the flange receiving portion 57*a*.

The lower die 60 comprises substantially columnar die body 61 and a sleeve 62 arranged around an upper half portion of the die body 61. The lower end of the sleeve 62 is received on a sleeve seat 63 that protrudes radially outward from the outer peripheral surface of the die body 61. At a radially inner portion of the upper surface of the sleeve 62, an annular washer rest 64 is provided, on which the outer portion 13*c* of the washer 13 is to be placed. The washer rest 64 is recessed downward. The upper end of the die body 61 is provided with an annular dent 65 for bending the cylindrical portion 12*a* of the eyelet body 12 radially outward in a C shape; and a fabric supporting portion 66 that is raised upward and radially inward from the dent 65. The fabric supporting portion 66 has an inclined surface 66*a* that is inclined continuously from the dent 65 radially inward and upward; and a circular horizontal surface 66*b* radially inside of the upper end of the inclined surface 66*a*. The horizontal surface 66*b* is located slightly above the upper end of the initial state sleeve 62 in FIG. 8.

Next, steps of attaching the eyelet member 11 to the fabric 1 using the upper die 50 and the lower die 60 will be described. The eyelet body 12 is held on the eyelet holding portion 57 of the upper die 50; the washer 13 is set to the washer rest 64 of the lower die 60; and further the fabric 1 is placed above the washer 13 (the fabric 1 is omitted in FIG. 8). Then, the upper die 50 is lowered by driving an elevating part of an eyelet attaching apparatus (not shown). Thereby, the lower end of the sleeve 52 of the upper die 50 and the lower surface of the fabric pressing body 53*a* abut against the upper end of the sleeve 62 of the lower die 60 and the horizontal surface 66*b* of the fabric supporting portion 66 of the die body 61, respectively, via the fabric 1, and therefore further downward displacement of the sleeve 52 and the fabric pressing body 53*a* is restricted. On the other hand, the die body 51 of upper die 50 continues to be further lowered to the position shown in FIG. 9. Thereby, the cylindrical portion 12*a* of the eyelet body 12 passes through the fabric 1 downward, and then passed through the hole 13*a* of the washer 13, and then is swaged by the dent 65 of the lower die 60 so as to be curved radially outward in a C shape, as shown enlarged in FIG. 9. The tip of the cylindrical portion 12 is received by the lower face (the up-and-down direction is based on the FIGS. 8 and 9 sheets) of the inner portion 13*b* of the washer 13. As a result, the eyelet member 11 is fixed to the fabric 1 with the fabric 1 being sandwiched between the flange portion 12*b* and the washer 13. As the cylindrical portion 12*a* of the eyelet body 12 passes through the fabric 1 downward, the tip of the cylindrical portion 12*a* cuts the fabric 1 while pressing the fabric 1 against the inclined surface 66*a* of the fabric supporting portion 66 of the die body 61 of the lower die 60. Further, at the swaging of the male-side eyelet body 12, the eight protrusion forming edges 58 provided at the lower end of the die body 51 of the upper die 50 bite into the flange portion 12*b* of the curved inner peripheral surface of the cylindrical portion 12 (See FIG. 9) and creates eight protrusions 15 on this inner peripheral surface (see the enlarged view of FIG. 10). When the female-side eyelet body 42 is swaged, there are no eight protrusion forming edges, so no such eight protrusions are formed on its inner peripheral surface. When the die body 51 is lowered to the lowermost position shown in FIG. 9, the springs 54, 55 are compressed by the spring seats 56, 55*a*, and therefore the sleeve 52 and the fabric pressing member 53 of the upper die 50 are pushed downward. Thereby, the fabric 1 is firmly held between the lower end of the sleeve 52 and the lower end surface of the fabric pressing body 53; and the upper end of the sleeve 62 of the lower die 60 and the horizontal surface 66*b* of the fabric supporting portion 66 of the die body 61. Thus, the fabric 1 is prevented from being pulled and displaced by the tip of the cylindrical portion 12*a* when the cylindrical portion 12*a* of the eyelet body 12 are passing through the fabric 1. In this way, the fabric 1 is smoothly cut by the cylindrical portion 12*a*.

A female snap 40 is the same as the eyelet member 11 of the male snap 10, on which the protrusions 15 are not formed. Therefore, an upper die used for attaching the female snap 40 to the fabric 2 has no protrusion forming edges 58, as compared with the upper die 50 as described above. A lower die 60 is the same structure as the above-described lower die 60.

Next, a step will be described, where the initial engaging member 20A is fixed to the male eyelet member 11 attached to the fabric 1 and the projections 35 are created on the initial engaging member 20A. FIG. 11 is a cross-sectional explanatory view schematically showing an upper die 70 for holding the initial engaging member 20A during the step, and a lower die 80 for setting the eyelet member 11 that has been attached to the fabric 1. FIG. 12 is a cross-sectional explanatory view showing a state where the initial engaging member 20A is held by an upper die 70 shown in FIG. 11 and the eyelet member 11 attached to the fabric 1 is set to a lower die 80 (for the sake of convenience, it shows the eyelet member 11 immediately before being set). The upper die 70 comprises a columnar die body 71; a holder 74 for covering the lower portion of the die body 71 and for holding the initial engagement member 20A; and an elastic member 75 arranged above the holder 74 and around the die body 71. The elastic member 75 may be formed into a cylindrical shape. The die body 71 is made of steel or the like. The holder 74 is made of synthetic resin or metal. The elastic member 75 is made of elastic material such as urethane, elastomer and the like. The die body 71 according to the embodiment has six punch dies 72 protruding downward from the lower end surface of the die body 71, the six punch dies 72 being arranged in the circumferential direction. Each punch die 72 is for forming each projection 35 on the initial engagement member 20A, and has a circular horizontal cross section. At an almost middle part, in the up-and-down direction, of the die body 71, a receiving portion 73 is provided for receiving the upper end surface of the elastic member 75. The receiving portion 73 protrudes radially outward. The upper end portion of the inner peripheral surface of the elastic member 75 is provided with a decreased diameter portion 75*a* having a slightly decreased inner diameter. Immediately below the receiving portion 73 on the outer peripheral surface of the die body 71, there is an annular recess 71*a* that has a slightly decreased outer diameter. The annular recess 71*a* can fit the decreased diameter portion 75*a* of the elastic member 75. By fitting the decreased diameter portion 75*a* into the recess 71*a*, the elastic member 75 is installed on the die body 71.

The holder 74 includes a cylindrical peripheral side portion 74*a* disposed around the lower portion of the die body 71; and a bottom portion 74*b* for closing the lower side of the peripheral side portion 74*a* except for punch holes 74*c* as described below. The lower surface of the bottom portion 74*b* of the holder 74 is provided with a holding portion 76 recessed upward for holding the initial engaging member 20A. The holding portion 76 has a shape that conforms to the connecting part 30 of the initial engaging member 20A. The bottom portion 74*b* of the holder 74 is provided with six punch holes 74*c* through which six punch dies 72 can pass. The lower end of each punch hole 74*c* opens to the holding portion 76. The upper end portion of the peripheral side portion 74*a* of the holder 74 is supported by the elastic member 75. The peripheral side portion 74*a* includes an annular convex key 74*d* extending upward further from the radially inner region of the upper end surface of the peripheral side portion 74*a*. The outer diameter of the convex key 74*d* slightly expands upward. The elastic member 75 includes a concave key 75*b* that is recessed upward from the radially inner region of the lower end surface of the elastic member 75. The concave key 75*b* is engaged with the convex key 74*d*. The inner diameter of the concave key 75*b* slightly expands upward. The peripheral side portion 74*a* of the holder 74 and the elastic member 75 are connected to each other via the engagement of the convex key 74*d* with the concave key 75*b*.

In FIGS. 11 and 12, the upper die 70 is in an initial state where no force acts on the holder 74 and the elastic member 75. In this initial state, there is a clearance C between the lower end surface of the die body 71 and the upper surface of the bottom portion 74*b* of the holder 74. The distance between the upper and lower ends of the clearance C is the maximum in the initial state, and it narrows during the steps of fixing the initial engaging member 20A as described below and of creating the projections 35 on the initial engaging member 20A. Further, in the initial state, the lower end of each punch die 72 is above the lower end of the punch hole 74*c* within the punch hole 74*c* of the bottom portion 74*b* of the holder 74 and does not protrude into the holding portion 76.

The lower die 80 comprises a die body 81 for swaging the initial engaging member 20A as described below; an elastic member 82, which is disposed around the die body 81 and on which the eyelet member 11 attached to the fabric 1 is placed; and a supporting member 83 for supporting the die body 81 via a coiled spring 84 and also supporting the elastic member 82. The die body 81 is made of steel or the like. The elastic member 82 is made of elastic material such as urethane, elastomer and the like. The supporting member 83 is made of metal. The die body 81 includes an upper half portion 81*a*; a lower half portion 81*b* having a slightly smaller outer diameter than that of the upper half portion 81*a*; and a spring receiving portion 81*c* that radially outwardly protrudes between the upper and lower half portions 81*a*, 81*b*. The supporting member 83 includes a spring housing portion 83*a* that is a columnar space for housing the spring 84. The spring housing portion 83*a* opens to the upper end surface of the supporting member 83. In the initial state of the lower die 80 where substantially no force acts on the die body 81 and the elastic member 82 (see FIGS. 11 and 12), the spring 84 housed in the spring housing portion 83*a* protrudes above the upper end surface of the supporting member 83 and receives the lower half portion 81*b* of the die body 81 therein, and the upper end of the spring 84 is in contact with the spring receiving portion 81*c* of the die body 81. In this initial state, there is a clearance D between the upper end surface of the supporting member 83 and the spring receiving portion 81*c*. The vertical space of the clearance D is the maximum in the initial state, and it narrows during the steps of fixing of the initial engaging member 20A and creating of the projections 35 on the initial engaging member 20A, as described below. In addition, there is a gap larger than the clearance D between the lower end of the lower half portion 81*b* of the die body 81 and the bottom surface of the spring housing portion 83*a*.

The supporting member 83 includes a receiving portion 83*b* for receiving the lower end surface of the elastic member 82, and the receiving portion 83*b* radially outwardly protrudes slightly above the bottom surface of the spring housing portion 83*a* in the up-and-down direction. The elastic member 82 is divided into an upper portion 82*a* above the spring receiving portion 81*c* of the die body 81 and a lower portion 82*b* below the upper portion 82*a*. The upper portion 82*a* has a smaller inner diameter than that of the lower portion 82*b*, and the inner diameter of the upper portion 82*a* is substantially the same as the outer diameter of the upper half portion 81*a* of the die body 81. The spring receiving portion 81*c* of the die body 81 is in contact with the lower end of the upper half portion 82*a* of the elastic member 82 in the initial state. The inner diameter of the lower portion 82*b* of the elastic member 82 is substantially the same as the outer diameter of the upper portion 83*c*, above the receiving portion 83*b*, of the support member 83. The upper portion 83*c* is provided with a projection 83*d* that protrudes radially outward in a triangular cross section. The lower portion 82*b* of the elastic member 82 is provided with a recess 82*c* that is engaged with the projection 83*d*.

The die body 81 includes an annular protruded portion 85 sharply protruding upwardly at the radially outer end on the upper end surface of the upper half portion 81*a*; and a raised portion 86 that is raised upward from the upper end surface of the upper half portion 81*a* in the radially inward region from the protruded portion 85, and higher than the protruded portion 85. The raised portion 86 has a shape that can fit into the space 24 radially inside the fixing part 21 of the initial engaging member 20A (see FIG. 14). The elastic member 82 has, on its upper end surface, an eyelet-placed portion (eyelet-receiving portion) 87, which is an annular recess for setting the eyelet member 11 that has been attached to the fabric 1. In the initial state of the lower die 80 shown in FIGS. 11 and 12, the die body 81 is in the uppermost position where the spring receiving portion 81*c* supported by the spring 84 is in contact with the lower end surface of the upper portion 82*a* of the elastic member 82. At this time, the upper half portion 81*a* of the die body 81 partially projects above the upper end of the elastic member 82, and the protruded portion 85 and the raised portion 86 are located above the eyelet-placed portion 87.

When creating the projections 35 on the initial engaging member 20A and fixing the initial engaging member 20A as the engaging member 20 to the eyelet member 11, the connecting part 30 of the initial engaging member 20A is held by the holding portion 76 of the upper die 70, as shown in FIG. 12. Also, the eyelet member 11 attached to the fabric 1 is set on the eyelet-placed portion 87 of the lower die 80. At this time, the upper half portion 81*a* of the die body 81 is passed through the opening 14 of the eyelet member 11. The upper die 70 is then lowered from the initial state of FIG. 12. Thereby, the initial engaging member 20A is pushed into the opening 14 of the eyelet member 11 supported by the eyelet-placed portion 87 of the elastic member 82 that is supported by the supporting member 83. When the upper die 70 is further lowered, as shown in FIGS. 13 and 14, the upper die 70 pushes down, via the initial engagement member 20A, the die body 81 of the lower die 80 from the uppermost position to the lowermost position where the spring-receiving portion 81*c* abuts against the upper end surface of the supporting member 83. This allows the spring 84 to be compressed by the spring-receiving portion 81*c*. FIG. 13 shows a state immediately before the die body 81 reaches the lowermost position, where the clearance D between the spring-receiving portion 81*c* and the supporting member 83 remains. FIG. 14 shows the lowermost position where the spring-receiving portion 81*c* contacts the upper end surface of the support member 83. At this time, the clearance D that was present between the spring receiving portion 81 *c* and the support member 83 disappears. Also, at this time, the lower end of the die body 81 does not reach the bottom surface of the spring housing portion 83*a*. Further, at the time point of FIG. 13, the raised portion 86 of the die body 81 of the lower die 80 gets into the space 24 on the radially inner side of the fixing part 21. Furthermore, at the time point of FIG. 13, the fixing part 21 of the initial engaging member 20A is partially inserted into the opening 14 of the eyelet member 11, but the press-fitting of the fixing part 21 into the opening 14 has not yet completed.

The upper die 70 is further lowered slightly to the position shown in FIG. 14, and thereby the initial engaging member 20A is fixed to the eyelet member 11 while the projections 35 are formed on the initial engaging member 20A as described below in detail. When the upper die 70 is displaced downward from the time point of FIG. 13 to the time point of FIG. 14, the fixing part 21 of the initial engaging member 20A is first press-fitted into the opening 14 of the eyelet member 11; the fixing part 21 of the initial engaging member 20A is then swaged to the opening 14 of the eyelet member 11; and the projections 35 are then formed on the post 34 of the initial engaging member 20A. It can be said that these operations are carried out almost at the same time, but strictly they are carried out in the above-mentioned order. During the press-fitting of the fixing part 21 into the opening 14 of the eyelet member 11, a force for pushing the fixing part 21 into the opening 14 of the eyelet member 11 is received by the elastic member 82 as being elastically deformed of the lower die 80. Further, a force for swaging the fixing part 21 of the initial engaging member 20A is received by, in addition to the elastically deformed elastic member 82 of the lower die 80, the elastic member 75 as being elastically deformed of the upper die 70. Furthermore, a force for forming the projections 35 on the initial engaging member 20A is received by, in addition to the above-mentioned elastically deformed upper and lower elastic members 82, 75, the elastic member 75 as being further elastically deformed. These will be described below in detail.

When the upper die 70 is displaced downward from the time point of FIG. 13 to the time point of FIG. 14, the upper die 70 pushes down the die body 81 of the lower die 80 via the initial engaging member 20A. At this time, the fixing part 21 of the initial engaging member 20A is pushed into the opening 14 of the eyelet member 11 set on the eyelet-placed portion 87 of the elastic member 82 of the lower die 80. Accordingly, the flange 22 of the initial engaging member 20A pushes down the eyelet member 11 so as to cover the cylindrical portion 12*a* of the eyelet member 11. Thereby, the elastic member 82 of the lower die 80 is compressed in the up-and-down direction (the axial direction) while being elastically deformed such that its middle part, in the up-and-down direction, expands radially outward (see FIG. 14). A compressive reaction force of the elastic member 82 as being elastically deformed acts to relatively lift up the eyelet member 11 relative to the initial engagement member 20A which is being displaced downward. As a result, the fixing part 21 of the initial engaging member 20A is press-fitted into the opening 14 of the eyelet member 11. The force for press-fitting the fixing part 21 into the opening 14 is received by the elastically deformed elastic member 82.

The press-fitting of the fixing part 21 of the initial engaging member 20A into the opening 14 of the eyelet member 11 is completed, and at almost the same time, the die body 81 of the lower die 80 is displaced to the lowermost position where the spring-receiving portion 81*c* abuts against the upper end surface of the support member 83, so that further downward displacement of the die body 81 is restricted. Then, by this die body 81 whose further downward displacement is restricted, further downward displacement of the holder 74 of the upper die 70 is also restricted via the initial engagement member 20A. After that, however, the die body 71 of the upper die 70 is slightly lowered to the lowermost position of FIG. 14. Thus, the elastic member 75 of the upper die 70 is compressed in the axial direction (the up-and-down direction) between the receiving portion 73 of the die body 71 and the peripheral side portion 74*a* of the holder 74, and thereby the elastic member 75 is slightly compressed in the axial direction while being elastically deformed such that its middle part, in the up-and-down direction, expands radially outward (see FIG. 14). A compression reaction force of the elastic member 75 as being elastically deformed acts to press the initial engagement member 20A against the die body 81 of the lower die 80 via the holder 74. Thereby, the fixing part 21 of the initial engaging member 20A is swaged by the projecting portion 85 of the die main body 81 as follows. That is, as shown in the enlarged view of FIG. 15, the protruded portion 85 of the die body 81 bites into the fixing part 21 of the initial engaging member 20A from the lower surface thereof. Thereby, the material of the radially outer portion of the fixing part 21 is forced radially outward and pressed against the protrusions 15 of the eyelet member 11. As a result, the fixing part 21 of the initial engaging member 20A is fixed to the eyelet member 11 so as not to be detachable from the opening 14. The swaging of the fixing part 21 of the initial engaging member 20A to the opening 14 of the eyelet member 11 is thus completed. The force for swaging the fixing part 21 of the initial engaging member 20A as stated above is received by both of the elastically deformed elastic member 82 of the lower die 80 and the elastically deformed elastic member 75 of the upper die 70. On the lower surface of the fixing part 21 of the engaging member 20 of the male snap 10, there remains a mark as the swaged mark 21*a* formed by the biting into of the protruded portion 85. In the step of fixing the fixing part 21 of the initial engaging member 20A to the eyelet member 11 as stated above, the raised portion 86 of the lower die 80 fits into the space 24 of the initial engaging member 20A, whereby the centering (aligning) of the initial engaging member 20A is accurately carried out. Further, since the elastic member 75 of the upper die 70 and the elastic member 82 of the lower die 80 are elastically deformed while sandwiching and holding the flange 22 of the initial engaging member 20A and the eyelet member 11, the swaging process of the fixing part 21 of the initial engaging member 20A to the eyelet member 11 is stably carried out.

After the upper die 70 pushes down the die body 81 of the lower die 80 to the lowermost position via the initial engaging member 20A, and the holder 74 is restricted in downward displacement as stated above, the die body 71 of the upper die 70 slightly moves downward. Thereby, the elastic member 82 is further elastically deformed from the time point of swaging of the fixing part 21 of the initial engaging member 20A, and the lower end surface of the die body 71 comes close to the upper surface of the bottom portion 74*b* of the holder 74, so that the vertical distance of the clearance C that was present therebetween is being decreased (see FIG. 14). Accordingly, the six punch dies 72 project downward from the lower end of the punch holes 74*c* of the holder 74, and crush, from above, parts of the post 34 of the connecting part 30 of the initial engagement member 20A held by the holding portion 76. Consequently, the six hollows 36 are formed in the circumferential direction. Each of the hollows 36 is depressed downward from the upper surface 34*a* of the post 34, and the material of the post 34 corresponding to each hollow 36 bulges radially outward so as to form the six projections 35. The force for forming the projections 35 on the initial engaging member 20A as stated above is received by the elastic member 82 of the lower die 80 as being elastically deformed and by the elastic member 75 of the upper die 70 as being elastically deformed more than the elastic deformation at time of the swaging of the fixing part 21. Further, the degree of the deformation of the projections 35 relative to the initial engaging member 20A, that is, the depth of the hollows 36 from the upper surface 34*a* of the post 34 and the degree of radially outward protrusion of the projections 35, can be adjusted desirably by changing an amount of descent of the punch dies 72 from the initial position, namely, the stroke of the die body 71. The initial engaging member 20A is thus fixed to the eyelet member 11 in the fabric 1 while being formed into the engaging member 20. It should be noted that during the forming of the projections 35 by the punch dies 72, the fixing part 21 of the initial engaging member 20A is pressed against the die body 81 of the lower die 80, which facilitates the swaging of the fixing part 21 by the protruded portion 85. Although the degree of curvature of the inner peripheral surface of the cylindrical portion 12*a* defining the opening 14 of the eyelet member 11 varies depending on the thickness of the fabric 1, it is possible to reliably secure the fixing part 21 to the opening 14 of various eyelet members 11 having different degrees of curvature by fixing the fixing part 21 to the opening 14 while forming the projections 35 on the post 34 of the connecting part 30 using the punch dies 72.

In the step of fixing the initial engaging member 20A to the opening 14 of the eyelet member 11 and forming the projections 35 on the initial engaging member 20A, it is important to manage the following three forces: 1) a force for pushing the fixing part 21 of the initial engaging member 20A into the opening 14 of the eyelet member 11 (this force is received by the elastic member 82 with a certain flexibility of the lower die 80); 2) a force for swaging the fixing part 21 of the initial engaging member 20A (This force is received by the elastic member 75 with a certain flexibility of the upper die 70; therefore, the elastic member 75 of the upper die 70 receives the sum of the forces 1) and 2) with a certain flexibility); and 3) a force for forming the projections 35 on the initial engaging member 20A (the elastic member 75 is further elastically deformed from the above 2) state by the die body 71 lowering relative to the holder 74 that is restricted in lowering, so that the projections 35 are formed on the initial engaging member 20A by the die punches 72; the force 3) exceeds the sum of the forces 1) and 2) as described above). Once the holder 74 of the upper die 70 presses the initial engaging member 20A against the die body 81 of the lower die 80, which was lowered to the lowest position, the elastic member 82 undergoes elastic deformation. When a compressive reaction force in the axial direction applied by the elastically deformed elastic member 82 exceeds the force 1), the fixing part 21 of the initial engaging member 20A will be in a state where the fixing part 21 is sufficiently pushed into the opening 14 of the eyelet member 11. The upper die 70 then compresses the initial engaging member 20A against the die body 81 of the lower die 80 until the swaging of the fixing part 21 is sufficiently achieved. At this time, in addition to the elastic deformation of the elastic member 82 of the lower die 80, the elastic member 75 of the upper die 70 also undergoes elastic deformation by receiving the reaction force from the lower die 80, and the elastic deformation of the elastic member 75 continues until the projections 35 are completed on the initial engaging member 20A by the die punches 72. In other words, the force at the time when the elastic member 75 is elastically compressed needs to be larger than the above force 1) and further needs to exceed the sum of the forces 1) and 2). Furthermore, the initial engaging member 20A needs to have strength, namely, compressive proof strength, capable of withstanding the force received from the most elastically compressed elastic member 75. Here, when each of the forces 1) and 2) is X kg, and the force 3) is Y kg, the initial engaging member 20A is compressed by the total force (2X+Y) kg. At this time, assuming that lengths shortened in the axial direction (elastic deformation quantity) of the elastic members 75 and 82 due to their respective elastic deformation are L mm and N mm, respectively, the spring constant of the elastic member 75 needs to be set to (2X+Y)/L (kg/mm) or more, and the spring constant of the member 82 needs to be set to (2X+Y)/N (kg/mm) or more.

Referring to FIG. 3, when the male snap 1 engages with the female snap 2, the connecting part 30 of the engaging member 20 of the male snap 1 is connected to the opening 41 of the female snap 40. During this connection, when the head portion 32 of the cylindrical portion 31 of the connecting part 30 passes through the opening 41, the cylindrical portion 31 is temporarily elastically deformed radially inward and immediately after that, it is restored radially outward. This radially inward elastic deformation of the cylindrical portion 31 is restricted in the parts of the cylindrical portion 31 corresponding to the six projections 35 protruding from the post 34 by contacting each projection 35. On the other hand, in the parts of the cylindrical portion 31 corresponding to the regions between two projections 35 adjacent in the circumferential direction, there is no restriction by the projections 35. Therefore, the radially inward elastic deformation of the cylindrical portion 31 is relatively large. Thus, the projections 35 on the post 34 create larger and smaller elastically deformed parts of the cylindrical portion 31 alternately in the circumferential direction. Therefore, it is possible to desirably adjust the force required to engage and disengage the male snap 10 with and from the female snap 40 and/or the strength against a lateral pulling force acting on the male snap 10 as engaging with the female snap 40 (resistance to separation from the female snap 40), by changing the number, shape or the like of the projections provided on the post 34 of the connecting part 30.

FIG. 16 is a top view showing an engaging member 120 that is a variation of the engaging member of the male snap 10, and FIG. 17 is a sectional view taken along A-A in FIG. 16. The engaging member 120 includes a connecting part 130 connectable to and disconnectable from the opening 41 of the female snap 40; a fixing part 121 to be fixed to the opening 14 of the male eyelet member 11; a flange 122 slightly protruding radially outward between the connecting part 130 and the fixing part 121; and a base 123 that is present between the connecting part 130 and the fixing part 121 and radially inside of the flange 122. The connecting part 130 includes a cylindrical portion 131 extending upward from the base 123; and a post 134 raised upward from the base 123 radially inward from the cylindrical portion 131. Between the cylindrical portion 131 and the post 134, there is an annular gap 139 that opens upward. The connecting part 130 and the post 134 have substantially the same forms as those of the connecting part 30 and the post 34 of the initial engaging member 20A as described above. There is a space 124 radially inward from the fixing part 121, and the space 124 opens downward. In the engaging member 120, projections and hollows are provided in the post 134, as with the engaging member 20 as described above. Therefore, it can be said that the engaging member 120 corresponds to the initial engaging member 120A before forming the projections and hollows. As with the fixing part 21 of the engaging member 20, the fixing part 121 of the engaging member 120 is swaged so as to be pressed against the protrusions 15 during the fixing of the eyelet member 11 to the opening 14. The cylindrical portion 131 of the engaging member 120 includes a head portion 132 that is an upper end portion having a relatively large outer diameter; and a neck portion 133 having a slightly smaller outer diameter than that of the head portion 132. The cylindrical portion 131 is provided with three slits 131*a* at an interval of 120° in the circumferential direction, as an example. Each of the slits 131*a* penetrates the thickness of the cylindrical portion 131 along the radial direction and is formed over the entire height of the cylindrical portion 131 from its upper end. Such slits 131*a* facilitate elastic deformation of the cylindrical portion 131 when the male snap 10 including the engaging member 120 engages and disengages with and from the female snap 40. It should be noted that the number of the slits 131*a* may be 0 to 30 or more. The radially outward length of the flange 122 of the engaging member 120 is shorter than that of the flange 22 of the engaging member 20 as described above. Accordingly, the material cost of the engaging member 120 can be reduced.

FIG. 18 is a sectional explanatory view showing a male snap 110 comprising the above engaging member 120 and the eyelet member 11 (which is substantially the same as the eyelet member 11 of the male snap 10 and thus the same reference numeral is used). The engaging member 120 can be fixed to the eyelet member 11 using the upper and lower dies 70, 80 as described above in the same way as for the engaging member 20. It should be noted that in FIGS. 18 to 20, the projections of the engaging member 120, which can be formed by the upper die 70, are omitted from the drawings. FIG. 19 is a cross-sectional explanatory view showing a male snap 110*a*, in which the engaging member 120 is fixed to the eyelet member 11 turned upside down. Such a male snap 110*a* can be obtained by turning the eyelet member 11 upside down and setting it to the eyelet-placed portion 87 of the lower die 80, and then lowering the upper die 70 holding the engaging member 120. Although not shown, the engaging member 20 can also be fixed to the eyelet member 11 turned upside down. In the male snap 110*a*, the protrusions 15 of the eyelet member 11 bite into, at more proximal side of the fixing part 121 as compared with the male snap 110 (FIG. 18), the outer peripheral surface of the fixing part 121 of the engaging member 120. FIG. 20 is a cross-sectional explanatory view showing a state where the male snap 110*a* is engaged with the female snap 40 attached to the fabric 2 as described above.

FIG. 21 shows a measuring tool 140 for detecting the quality of the projections 35 formed on the engaging member 20 of the male snap 10, based on the depth of the hollows 36. The measuring tool 140 includes a box-shaped main body 141 and six columnar bar-shaped probes 142 each protruding downward from the main body 141. Each probe 142 is a sensor capable of measuring the depth of each hollow 36 of the engaging member 20. The main body 141 includes a controller (not shown) for determining whether or not input from each probe 142, namely, a depth of each hollow 36 is within a predetermined range; and a monitor or a buzzer for outputting an alarm if the controller determined that there is a defect because input from a certain probe 142 is not within the predetermined range. The diameter of each probe 142 may be any size as long as it can be smoothly inserted into each hollow 36 of the engaging member 20. When determining whether the projections 35 of the engaging member 20 are good or bad, the measuring tool 140 is arranged with respect to the engaging member 20 of the male snap 10 such that each probe 142 is vertically aligned with each hollow 36. The measuring tool 140 is then lowered until all the probes 142 come into contact with the upper surface of each projection 35 by a vertical driving mechanism (not shown). For example, when a hollow 36 of the engaging member 20 is too shallow or a hollow 36 is not formed at all, the controller will determine that the input from the probe 142 corresponding to that hollow 36 is defective and then output an alarm. It is thought that such a hollow 36 would be deficient in an amount of being hit by the punch die 72. On the other hand, if a certain hollow 36 is too deep, the controller will determine that it is a defect based on the input from the probe 142 corresponding to that hollow 36. It is thought that such a hollow 36 would be excessively hit by the punch die 72, increasing a risk of destruction of the engaging member 20 itself.

DESCRIPTION OF REFERENCE NUMERALS

1, 2 fabric
10, 110, 110 male snap
11 male eyelet member
12 eyelet body
12*a* cylindrical portion
12*b* flange portion
13 washer
14 opening
15 protrusion
20, 120 engaging member
20A initial engaging member
21, 121 fixing part
22, 122 flange portion
24, 124 space
30, 130 connecting member
31, 131 cylindrical portion
32, 132 head portion
33, 133 neck portion
34, 134 post
35 projection
36 hollow
39, 139 gap
40 female snap (female eyelet member)
41 opening
50 upper die
58 protrusion forming edge
60 lower die
70 upper die
71 die body
72 punch die
74 holder
75 elastic member
76 holding portion
80 lower die
81 die body
82 elastic member
83 supporting member
84 spring
85 protruded portion
86 raised portion
87 eyelet mounting portion
140 measuring tool
142 probe

What is claimed is:

1. A snap button comprising:

a female snap and a male snap engageable with and disengageable from the female snap, wherein the female snap comprises a female eyelet member defining an opening, wherein the male snap comprises a male eyelet member defining an opening and an engaging member fixed to the opening of the male eyelet member, and wherein the engagement member comprises a connecting part connectable to and disconnectable from the opening of the female eyelet member, and a fixing part fitted into the opening of the male eyelet member, wherein the connecting part of the engaging member includes a head portion having an outer diameter slightly larger than a diameter of the opening of the female eyelet member, and a neck portion having an outer diameter smaller than the outer diameter of the head portion, wherein the connecting part of the engaging member includes an elastically displaceable cylindrical portion having the head portion and the neck portion, and a post arranged radially inside the cylindrical portion, and wherein there is a gap between the cylindrical portion and the post.

2. The snap button according to claim 1, wherein the post of the connecting part of the engaging member includes, in a circumferential direction, a plurality of projections projecting radially outward.

3. The snap button according to claim 2, wherein the male eyelet member includes a plurality of protrusions in the circumferential direction, the protrusions each projecting radially inward from an inner peripheral surface defining the opening of the male eyelet member.

4. The snap button according to claim 3, wherein the fixing part of the engaging member is cylindrical, and wherein there is a space radially inside the fixing part, the space opening axially opposite to the connecting part.

5. The snap button according to claim 4, wherein a thickness of the fixing part along a radial direction is thicker than a thickness of the cylindrical portion along the radial direction.

6. The snap button according to claim 5, wherein the female eyelet member is made of metal and the engaging member is made of resin.

7. A method for forming a male snap, the method comprising:

a step A of attaching a male eyelet member to a fabric, the male eyelet member defining an opening; and a step B of fixing a fixing part of an engaging member to the opening of the male eyelet member, the fixing part fitted into the opening of the male eyelet member, the engaging member further comprising a connecting part connectable to and disconnectable from an opening defined in a female eyelet member, the connecting part of the engaging member including an elastically displaceable cylindrical portion and a post arranged radially inside the cylindrical portion with a gap between the cylindrical portion and the post, wherein the step B includes forming a plurality of projections projecting radially outward on the post in a circumferential direction.

8. The snap button according to claim 1, wherein the connecting part of the engaging member includes an elastically displaceable cylindrical portion having the head portion and the neck portion, and a post arranged radially inside the cylindrical portion, and wherein there is a gap between the cylindrical portion and the post.

9. The snap button according to claim 1, wherein the male eyelet member includes a plurality of protrusions in the circumferential direction, the protrusions each projecting radially inward from an inner peripheral surface defining the opening of the male eyelet member.

10. The snap button according to claim 1, wherein the fixing part of the engaging member is cylindrical, and wherein there is a space radially inside the fixing part, the space opening axially opposite to the connecting part.

11. The snap button according to claim 1, wherein the female eyelet member is made of metal and the engaging member is made of resin.

* * * * *